US008290405B2

(12) United States Patent
Okamoto et al.

(10) Patent No.: US 8,290,405 B2
(45) Date of Patent: Oct. 16, 2012

(54) IMAGE FORMING AGENT STORAGE CONTAINER HAVING A STIRRING PART AND A CONVEYING MEMBER

(75) Inventors: Masaya Okamoto, Saitama (JP); Kota Furuhata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 300 days.

(21) Appl. No.: 12/721,277

(22) Filed: Mar. 10, 2010

(65) Prior Publication Data

US 2010/0247153 A1 Sep. 30, 2010

(30) Foreign Application Priority Data

Mar. 25, 2009 (JP) ..... 2009-073065
Feb. 12, 2010 (JP) ..... 2010-028691

(51) Int. Cl.
*G03G 15/08* (2006.01)

(52) U.S. Cl. ..... 399/254; 399/262; 399/263

(58) Field of Classification Search ..... 399/254, 399/262–263

See application file for complete search history.

(56) References Cited

U.S. PATENT DOCUMENTS 6,418,290 B1 * 7/2002 Isomura et al. ..... 399/254
6,788,912 B2 * 9/2004 Isomura et al. ..... 399/254

FOREIGN PATENT DOCUMENTS

JP 07-032661 U 6/1995
JP 2006-139013 A 6/2006
JP 2007-093697 A 4/2007
JP 2008-090105 A 4/2008

OTHER PUBLICATIONS

Japanese Office Action dated May 8, 2009 in Japanese Application No. 2009-073065.
Japanese Office Action dated Sep. 4, 2009 in Japanese Application No. 2009-073065.
U.S. Appl. No. 12/721,281 by Kazunori Koshimori, et al., filed Mar. 10, 2010.
U.S. Appl. No. 12/721,294 by Masaya Okamoto, et al., filed Mar. 10, 2010.

* cited by examiner

*Primary Examiner* — David Gray
*Assistant Examiner* — G. M. Hyder
(74) *Attorney, Agent, or Firm* — Sughrue Mion, PLLC

(57) ABSTRACT

An image forming agent storage container includes a container body formed with a discharge hole, a rotary shaft, a stirring part, and a conveying member. The conveying member includes a first end portion, a second end portion and a slit. The first end portion comes into contact with a lower inner face of the container body. The second end portion comes into contact with an inner face of the container body which intersects the lower inner face. The slit is formed between the first end portion and the second end portion. A corner of the conveying member located between the first and second end portions is removed. The slit extends from a portion from which the corner is removed toward an inside of the conveying member.

14 Claims, 15 Drawing Sheets

IMAGE FORMING AGENT STORAGE CONTAINER HAVING A STIRRING PART AND A CONVEYING MEMBER

CROSS-REFERENCE TO RELATED APPLICATIONS

This application is based on and claims priority under 35 USC 119 from Japanese Patent Application Nos. 2009-73065 (filed Mar. 25, 2009) and 2010-28691 (filed Feb. 12, 2010).

BACKGROUND

Technical Field

The present invention relates to an image forming agent storage container, an image forming apparatus, and a method of filling an image forming agent.

SUMMARY

According to an aspect of the invention, an image forming agent storage container includes a container body, a rotary shaft, a stirring part and a conveying member. The container body is formed with a discharge hole that is used to discharge an image forming agent. The rotary shaft rotates in the container body. The stirring part rotates together with the rotary shaft and stirs an image forming agent stored in the container body. The conveying member has flexibility, rotates together with the rotary shaft, and conveys the image forming agent in the container body. The conveying member includes a first end portion, a second end portion and a slit. The first end portion comes into contact with a lower inner face of the container body and comes into contact with an upstream side and a downstream side, in a rotation direction of the conveying member, of a part where the discharge hole is formed. The second end portion comes into contact with an inner face of the container body which intersects the lower inner face. The slit is formed between the first end portion and the second end portion. A corner of the conveying member which is located between the first end portion and the second end portion is removed. In the corner, a tip end of the first end portion and a tip end portion of the second end portion coincide with each other. The slit extends from a portion from which the corner is removed toward an inside of the conveying member.

BRIEF DESCRIPTION OF THE DRAWINGS

Exemplary embodiments of the invention will be described in detail below based on the accompanying drawings, wherein:

FIG. 7A is a side view showing a state where the operating member is in a first position, FIG. 7B is a side view showing a state where the operating member is in a second position, and FIG. 7C is a side view showing a state where the operating member is in a third position;

FIG. 8A is a section view showing a state where the operating member is in the first position, FIG. 8B is a section view showing a state where the operating member is in the second position, and FIG. 8C is a section view showing a state where the operating member is in the third position;

FIG. 11A is an enlarged view showing a part of the conveying member provided in the storage container according to the exemplary embodiment of the invention, and FIG. 11B is an enlarged view showing a part of a conveying member of Comparative Example;

FIG. 13A is a right side view, and FIG. 13B is a sectional view taken along a line A-A in FIG. 13A;

DETAILED DESCRIPTION

Hereinafter, exemplary embodiments of the invention will be described with reference to the accompanying drawings.

Figure 1:
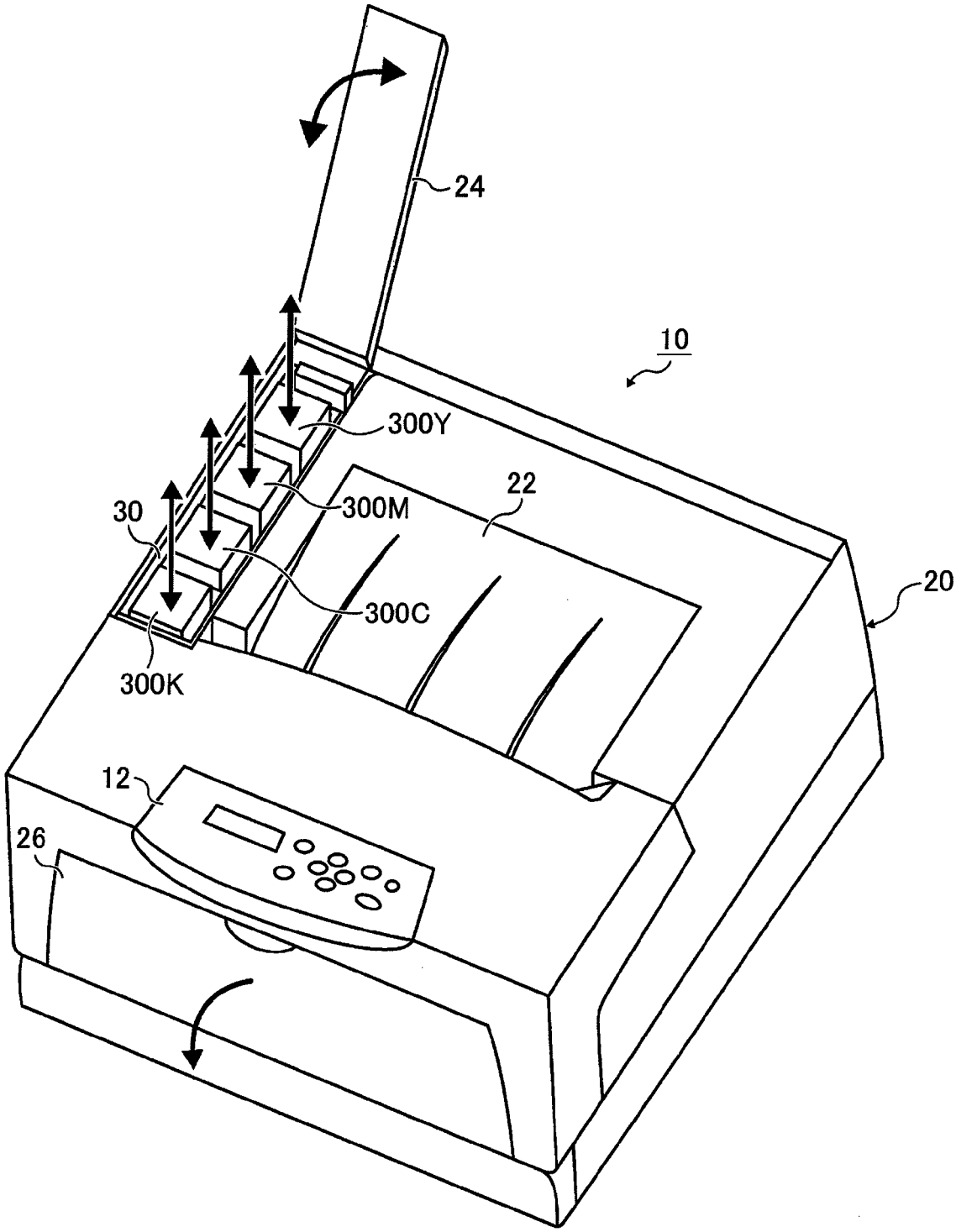
FIG. 1 is a perspective view showing an image forming apparatus according to an exemplary embodiment of the invention.

FIG. 1 shows an image forming apparatus 10 according to the exemplary embodiment of the invention. As shown in FIG. 1, the image forming apparatus 10 has an image forming apparatus body 20, and an upper part of the image forming apparatus body 20 is used as a discharge part 22 from which a paper on which an image has been formed is discharged. Also, an operation panel 12 used as an operation device is mounted to a front side of the image forming apparatus body 20.

A mounting opening and closing part 24, and a paper-feed opening and closing part 26 are mounted to the image forming apparatus body 20 so that each of them can be opened and closed. The mounting opening and closing part 24 is opened when storage containers 300Y, 300M, 300C, and 300K used image forming agent storage containers are mounted to the image forming apparatus body 20, and is opened when the storage containers 300Y, 300M, 300C, and 300K are detached from an inside of the image forming apparatus body 20. The mounting opening and closing part 24 is closed when image formation is performed. The paper-feed opening and closing part 26 is opened when papers on which images are to be formed are supplied from the front side of the image forming apparatus body 20. Also, the mounting opening and closing part 24 is opened and closed in a manner of rotating the mounting opening and closing 24 with the rear of the image forming apparatus body 20 in FIG. 1 used as a fulcrum (in such a manner that a fulcrum is formed on a short side of the mounting opening and closing part 24). However, this is not limited to the configuration of FIG. 1. The mounting opening and closing part 24 may be opened and closed in a manner of rotating the mounting opening and closing part 24 with a side of the image forming apparatus body 20 used as a fulcrum (in such a manner that a fulcrum is formed on a long side of the mounting opening and closing part 24). Also, a mounting device 30 on which the storage containers 300Y, 300M, 300C, and 300K are to be mounted is provided in the image forming apparatus body 20.

Yellow toner, magenta toner, cyan toner, and black toner used as image forming agents are respectively stored in the storage containers 300Y, 300M, 300C, and 300K. The storage containers 300Y, 300M, and 300C have the same shape and size, and are configured to be able to store the same capacity of toner. The storage container 300K is configured so as to be vertically longer than the storage containers 300Y, 300M, and 300C, and has a larger volume than the storage containers 300Y, 300M, and 300C, with a larger capacity that stores more toner than the storage containers 300Y, 300M, and 300C.

The storage containers 300Y, 300M, and 300C have different toner capacity from the storage container 300K, but have the same members and functions. Hereinafter, except for the case where a specific storage container is shown, the storage containers 300Y, 300M, 300C and 300K will be collectively referred to as the storage container 300.

Figure 2:
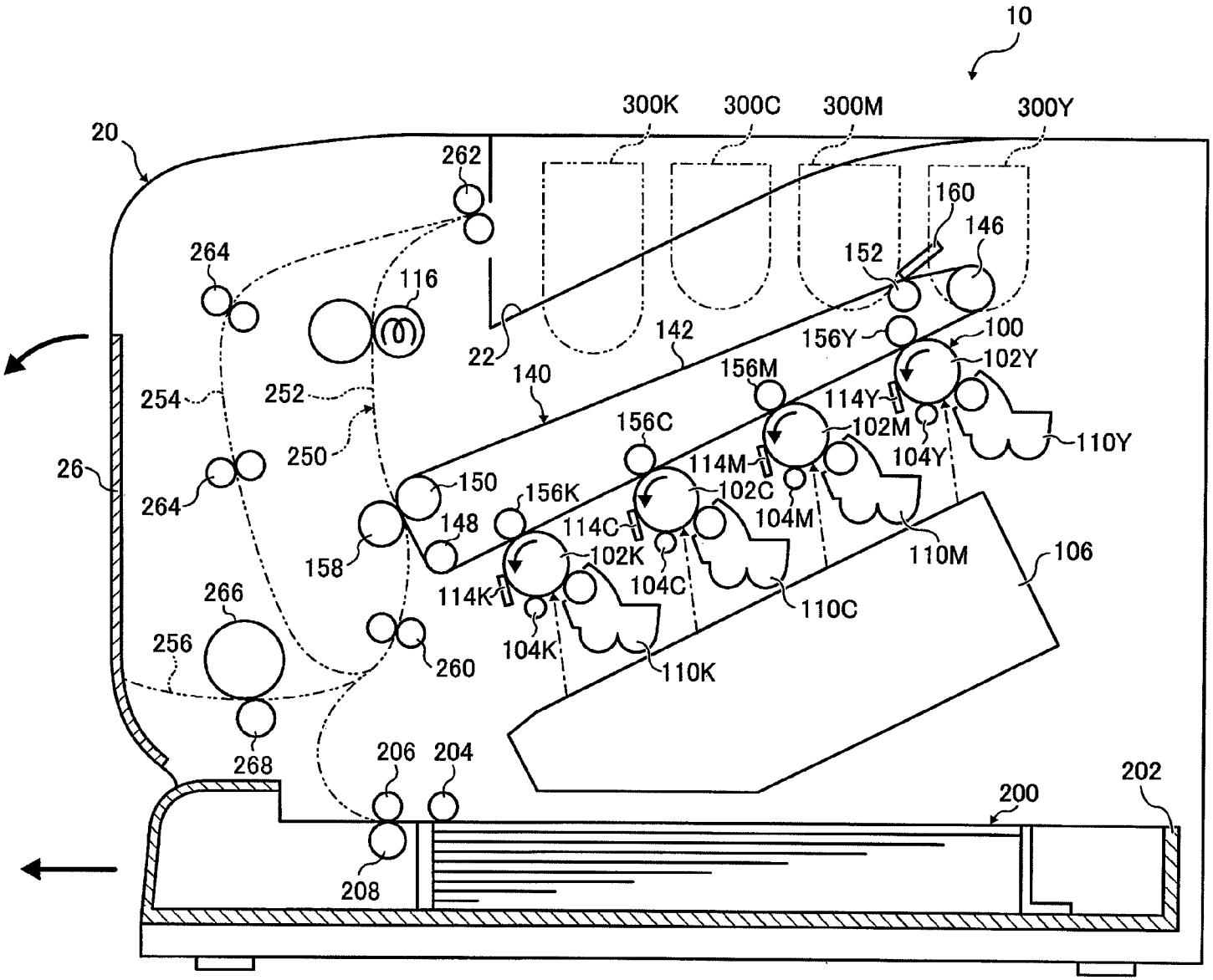
FIG. 2 is a side perspective view showing the image forming apparatus according to the exemplary embodiment of the invention.

FIG. 2 is a section of the image forming apparatus 10.

As shown in FIG. 2, an image forming part 100 and a paper feeder 200 which supplies papers to the image forming part 100 are mounted to the image forming apparatus body 20. Also, a conveyance path 250 used for conveyance of papers is formed in the image forming apparatus body 20.

The image forming part 100 has photosensitive drums 102Y, 102M, 102C, and 102K used as image carriers, charging devices 104Y, 104M, 104C, and 104K which respectively charge the photosensitive drums 102Y, 102M, 102C, and 102K, a latent image forming device 106 which emit light onto the photosensitive drums 102Y, 102M, 102C, and 102K charged by the charging devices 104Y, 104M, 104C, and 104K to form electrostatic latent images, and developing devices 110Y, 110M, 110C, and 110K which develop electrostatic latent images, which have been formed on the surfaces of the photosensitive drums 102Y, 102M, 102C, and 102K by the latent image forming device 106, using toner to form a yellow toner image, a magenta toner image, a cyan toner image, and a black toner image.

Yellow toner, magenta toner, cyan toner, and black toner are supplied to the developing devices 110Y, 110M, 110C, and 110K, respectively from the storage containers 300Y, 300M, 300C, and 300K.

Also, the image forming part 100 has a transfer device 140 which transfers to a paper the yellow toner image, the magenta toner image, the cyan toner image, and the black toner image, which have respectively been formed by the developing devices 110Y, 110M, 110C, and 110K. The image forming part 100 also has cleaning devices 114Y, 114M, 114C, and 114K which clean the surfaces of the photosensitive drums 102Y, 102M, 102C, and 102K, and a fixing device 116 which fixes the toner images transferred by the transfer device 140 to the paper.

The transfer device 140 has a belt-like intermediate transfer body 142 to which the yellow toner image, the magenta toner image, the cyan toner image, and the black toner image, which have been formed on the photosensitive drums 102Y, 102M, 102C, and 102K, are transferred so as to overlap each other, and which is used as a transfer medium. The intermediate transfer body 142 is supported by supporting rollers 146, 148, 150, and 152 so as to be rotatable.

Also, the transfer device 140 has primary transfer rollers 156Y, 156M, 156C, and 156K used as primary transfer devices which transfer to the intermediate transfer body the yellow toner image, the magenta toner image, the cyan toner image, and the black toner image, which have respectively been formed on the photosensitive drums 102Y, 102M, 102C, and 102K, and a secondary transfer roller 158 used as a secondary transfer device which transfers to a paper the yellow toner image, the magenta toner image, the cyan toner image, and the black toner image, which have been transferred to the intermediate transfer body 142. Also, the transfer device 140 has a cleaning device 160 which cleans the surface of the intermediate transfer body 142.

The paper feeder 200 has, for example, a paper housing part 202 which uses a cassette, an extraction roller 204 for extracting paper which is located at the uppermost position and which is housed in the paper housing part 202, a conveying roller 206 which conveys the paper extracted by the extraction roller 204 toward the image forming part 100, and a separating roller 208 which comes into contact with the conveying roller 206 and separates papers between the separating roller and the conveying roller 206. The paper housing part 202 is configured to be able to be pulled out, for example, to the front side (the left side in FIG. 2) of the image forming apparatus body 20, and papers are replenished into the paper housing part 202 in a state where the paper housing part has been pulled out from the image forming apparatus body 20.

The conveyance path 250 has a main conveyance path 252, a reverse conveyance path 254, and an auxiliary conveyance path 256.

The main conveyance path 252 is a conveyance path which conveys a paper supplied from the paper feeder 200 toward the discharge part 22, and is mounted with a registration roller 260, the secondary transfer roller 158, the fixing device 116, and a discharge roller 262 in order from the upstream side in a paper conveying direction, along the main conveyance path 252. The registration roller 260 starts its rotation at a predetermined timing from a stopped state, and supplies a paper to a contact portion between the intermediate transfer body 142 and the secondary transfer roller 158 so as to match the timing at which a toner image is transferred to the intermediate transfer body 142.

A discharge roller 262 discharges the paper on which the toner image is fixed by the fixing device 116 to the discharge part 22. Also, when images are to be formed on both faces of a paper, the discharge roller 262 rotates in a direction opposite to a direction for the case where a paper is discharged to the discharge part 22, and supplies the paper on which an image is formed on one surface thereof to the reverse conveyance path 254 from its rear end side.

The reverse conveyance path 254 is used when the paper one surface of which an image is formed on is again supplied to the upstream of the registration roller 260 while the paper is inverted. Two reverse conveying rollers 264 and 264 are mounted along the reverse conveyance path 254.

The auxiliary conveyance path 256 is a conveyance path used when a paper is supplied from the front side of the image forming apparatus body 20 in a state where the paper-feed opening and closing part 26 is opened with respect to the image forming apparatus body 20. An auxiliary conveying roller 266 which conveys a paper toward the registration roller 260, and a separating roller 268 which is used to contact with the auxiliary conveying roller 266 so as to separate the papers, are mounted along the auxiliary conveyance path 256.

FIGS. 3 to 6 show the storage container 300.

As described above, the respective storage containers 300Y, 300M, and 300C have the same shape and size, and the storage container 300K has a larger capacity than the storage containers 300Y, 300M, and 300C. FIGS. 3 to 6 show the storage container 300 used as the storage containers 300Y, 300M, and 300C.

As shown in FIGS. 3 to 6, the storage container 300 has a container body 310, an opening and closing part 350, an operating member 380 used as an operating part, and a gear 370 used as a driven transmission member. The storage container 300 is formed with a discharge hole 312 in a position which is a lower end side thereof in the direction of gravity in a state where the storage container 300 is mounted to the image forming apparatus body 20 (see FIG. 1). The discharge hole 312 is used for discharge of the toner out of the container body 310, and the toner is discharged so as to fall via the discharge hole 312. The toner discharged from the discharge hole 312 is supplied to the developing device 110 and is used for image formation.

The storage container 300 includes a stirring member 500 used as a stirring part for stirring the toner stored in the container body 310, a conveying member 600 used as a conveying part for conveying the toner in the container body 310, a rotary shaft 700 that rotates in the container body 310. The stirring member 500, the conveying member 600 and the rotary shaft 700 rotate in the container body 310 in an integrated manner.

Also, the container body 310 is formed with a filling hole 314, which is used to fill toner into the container body 310, in a position which is in an upper end side thereof in the direction of gravity in the state where the storage container 300 is mounted to the image forming apparatus body 20. The filling hole 314 is formed over substantially the whole region in the upward face of the container body 310, and toner is filled into the container body 310 via the filling hole 314 in such a manner that the toner is dropped from above in the direction of gravity. The shape of the filling hole 314 when viewed from above in the direction of gravity is substantially a rectangular shape. Therefore, the shape of the upward face of the container body 310 when viewed from above in the direction of gravity is also substantially a rectangular shape.

Also, a fixing projection 316 is formed on a front face of the container body 310 so as to project toward the front side. The fixing projection 316 is used as a fixing member which fixes the operating member 380 to a third position which will be described later.

Figure 5:
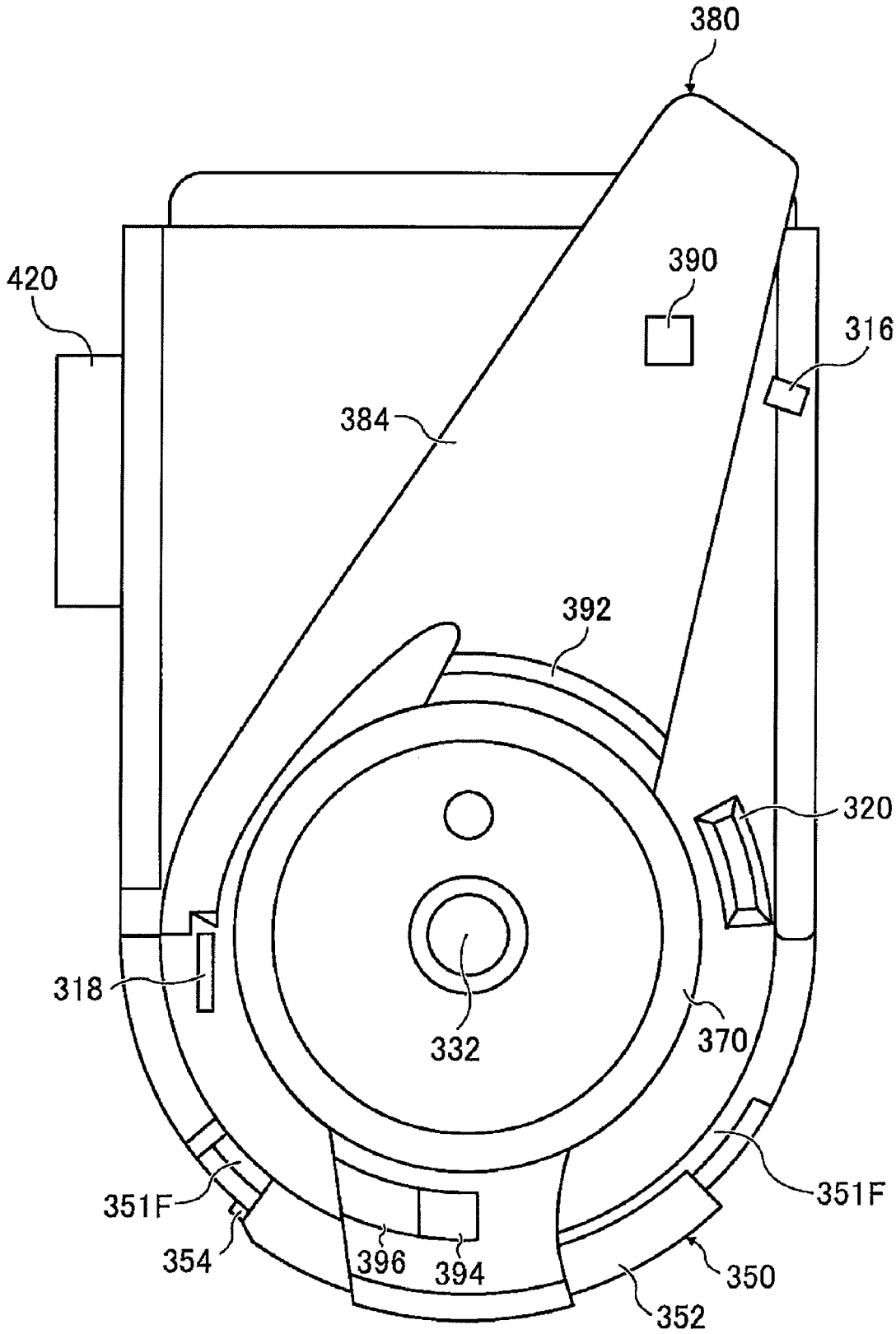
FIG. 5 is a side view showing the storage container according to the exemplary embodiment of the invention.

Also, a prohibiting projection 318 is formed on a front-side side face of the container body 310 so as to project toward the front side (see FIG. 5). The prohibiting projection 318 is used as a movement prohibiting member which prohibits the operating member 380 from moving from a second position which will be described later to a first position which will be described later. Also, the prohibiting projection 318 is used as an opening prohibiting member which prohibits the discharge hole 312 from being opened in a state where the container body 310 is not mounted to the image forming apparatus body 20.

Also, a protecting projection 320 is formed in a position on the front side of the container body 310 and near the gear 370, so as to project toward the front side. The protecting projection 320 makes it difficult for a face of the gear 370 on which teeth are formed to collide with other objects, thereby protecting the gear 370.

Also, a cylindrical-shaped supporting projection 324, which is used to rotatably support the operating member 380, is formed on a rear face of the container body 310. Also, a supporting projection (not shown), which is used to rotatably support the operating member 380, is formed on the front face of the container body 310 similarly to the supporting projection 324.

Also, the left face of the container body 310 is mounted with an identification member 420 which is used as an identification part. The identification member 420 has plural (for example, three) convex portions 422, and concave portions 424 are formed between the convex portions 422 which are adjacent to each other. The concave portions 424 are formed so that at least any one of the number, position, and width thereof differ according to a type of toner stored in the container body 310. At least any one of the number, position, and width of the concave portions 424 differ according to, for example, whether a color of toner stored in the container body 310 is yellow, magenta, or cyan. Also, even when, for example, black toner that is the same color is stored, if any of toners used for different types of models is stored, or if any of toners having different characteristics is stored, at least one of the number, position, and width of the concave portions 424 differs according to the model and the characteristic.

Also, printing or the like, which allows an operator or the like to identify the type of a toner to be filled or toner already filled, is formed on the identification member 420. This printing or the like is arranged in a position which can be viewed in a state where the operating member 380 is arranged at least at a second position which will be described later. Also, this printing or the like is also arranged on the operating member 380 or the upper face of a lid member 340 which will be described later.

Figure 4:
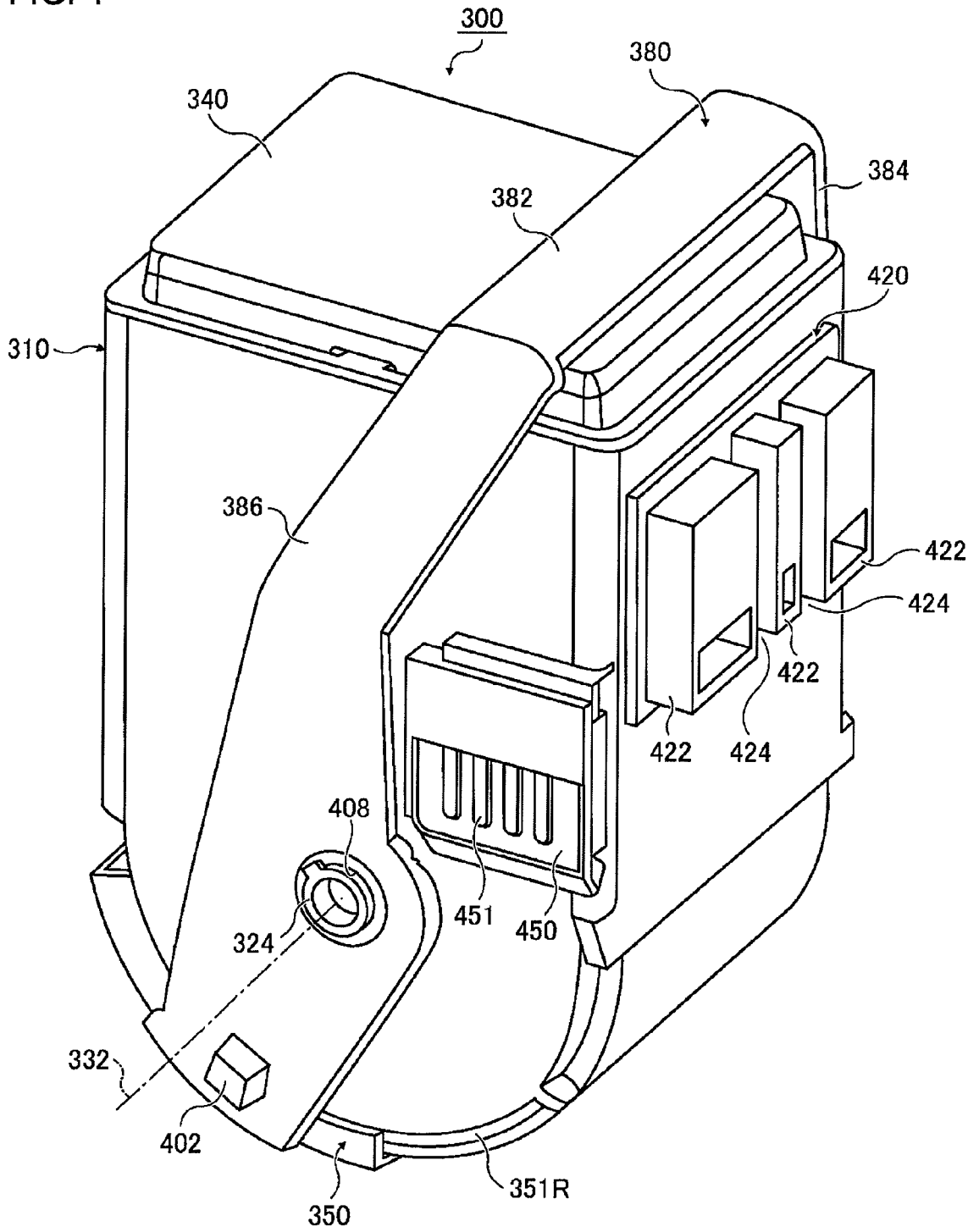
FIG. 4 is a second perspective view showing the storage container according to the exemplary embodiment of the invention.

Also, a storage medium 450 used as a storage device is mounted to the rear face of the container body 310 so as to be detachable from the container body 310. The storage medium 450 can be connected with a data writing device (not shown) provided on the image forming apparatus body 20, and data, such as the number of images formed with the toner stored in the storage container 300, from the data writing device is written therein. Connecting terminals 451 of the storage medium 450 extend so as to be long in the vertical direction, and are provided so that their lower portions including the lower ends in the vertical direction are exposed, and four connecting terminals are provided in the right-and-left horizontal direction. In the state of FIG. 4 where the opening and closing part 350 connected with the operating member 380 closes the discharge hole 312 (a state where the operating member 380 is in the second position), a lower portion (on the opening-and-closing-part-350 side) of a rear arm portion 386 of the operating member 380 retreats from the lower portions of the connecting terminals of the storage medium 450.

The opening and closing part 350 is attached so as to be movable to a lower position of the container body 310. As the opening and closing part 350 moves with respect to the container body 310, the discharge hole 312 is brought into an opened state or is brought into a closed state. The opening and closing part 350 has an opening and closing member 352 which is mounted so as to be movable with respect to the container body 310, and a sealing member 354 which is provided between the opening and closing member 352 and the container body 310 and is used to seal the discharge hole 312.

The operating member 380 has a facing portion 382 which is arranged in a position which faces the filling hole 314, a front arm portion 384 which extends from a front end of the facing portion 382, and the rear arm portion 386 which extends from a rear end of the facing portion 382. A through hole (not shown) is formed in the front arm portion 384 so that the supporting projection (not shown) formed on the front side of the container body 310 fits thereinto. A through hole 408 is formed in the rear arm portion 386 so that the supporting projection 324 formed on the rear face of the container body 310 fits thereinto.

The supporting projection formed in the front face of the container body 310 is inserted into the through hole formed in the front arm portion 384, and the supporting projection 324 is inserted into the through hole 408. Thereby, the operating member 380 is supported so as to be rotatable about the rotary axis, and can be moved between a first position, the second position, and the third position, which will be described later.

A through hole 390 is formed in the front arm portion 384. The through hole 390 is formed in a position where the fixing projection 316 fits thereinto in a state where the operating member 380 is arranged in the third position, which will be described later. For this reason, the operating member 380 is fixed by the through hole 390 and the fixing projection 316 to the third position with respect to the container body 310.

Also, a protecting projection 392 is formed in the front arm portion 384 so as to be located above the gear 370. The protecting projection 392 protects a face of the gear 370 on which teeth are formed, and keeps an operator from touching the gear 370 in a state where the storage container 300 is mounted to the image forming apparatus body 20.

Also, a guiding projection 394 is formed at the lower end of the front arm portion 384 and on a distal end side of the storage container 300 in a direction in which the storage container 300 is inserted into the image forming apparatus body 20. The guiding projection 394 is fitted into a guide groove (not shown) formed on the image forming apparatus body 20, and guides the mounting of the storage container 300 into the image forming apparatus body 20 and removing of the storage container 300 out of the image forming apparatus body 20.

Also, a collision suppressing projection 396 is formed, for example, with continuing to the guiding projection 394, at the lower end of the front arm portion 384 and on the distal end in the direction in which the storage container 300 is inserted into the image forming apparatus body 20. The collision suppressing projection 396 makes it difficult for the face of the gear 370 on which the teeth are formed to collide with the image forming apparatus body 20 when the storage container 300 is being inserted into the image forming apparatus body 20. Also, similarly to the collision suppressing projection 396, the guiding projection 394 has a function to make it difficult for the face of the gear 370 on which the teeth are formed to collide with the image forming apparatus body 20.

A guiding projection 402 is formed on the lower end side of the rear arm portion 386 similarly to the fact that the guiding projection 394 is formed on the front arm portion 384. The guiding projection 402 is fitted into a guide groove (not shown) formed on the image forming apparatus body 20, and guides attachment and detachment of the storage container 300 into and from the image forming apparatus body 20.

The operating member 380 and the opening and closing member 352 are connected with each other. That is, a portion of the front arm portion 384 on the lower end side thereof is connected with the front portion of the opening and closing member 352, and a portion of the rear arm portion 386 on the lower end thereof is connected with the rear portion of the opening and closing member 352. Therefore, the operating member 380 moves in conjunction with movement of the opening and closing member 352.

The gear 370 is mounted to the front face of the container body 310, and when the storage container 300 is mounted to the image forming apparatus body 20, the gear 370 is connected with a gear (not shown) provided on the image forming apparatus body 20 so as to receive a driving transmission force from this gear. The gear 370 is configured so that a portion of a rotary shaft thereof is inserted into the container body 310. The portion of the shaft inserted into the container body 310 is mounted to the rotary shaft 700. Therefore, the stirring member 500, the conveying member 600, and the rotary shaft 700 receives a driving transmission force from the gear 370, and rotates integrally with the gear 370

Figure 3:
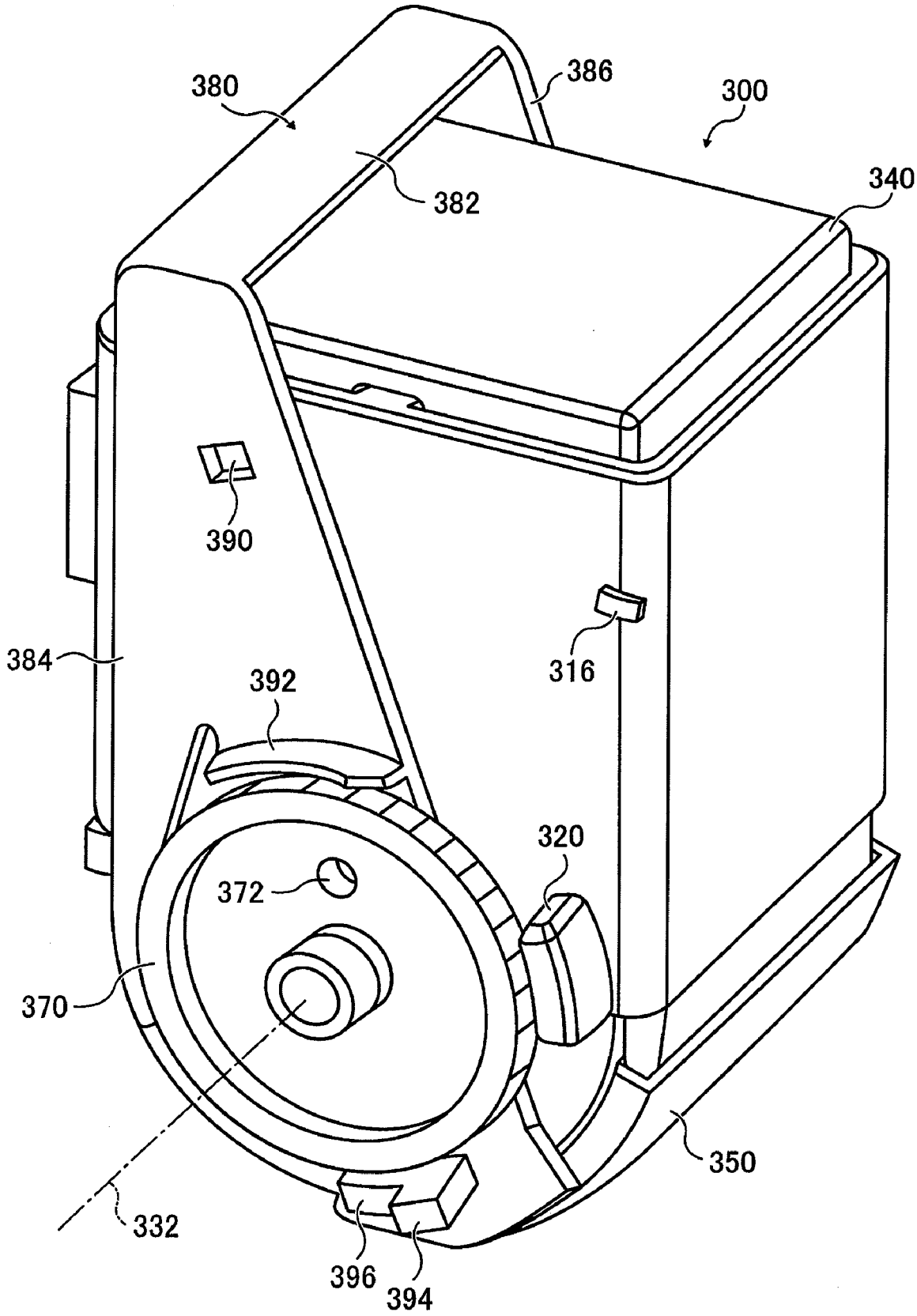
FIG. 3 is a first perspective view showing a storage container according to the exemplary embodiment of the invention.

The gear 370 is formed with a through hole 372 which is used as a position detecting part. Since the through hole 372 is formed at a position in the gear 370 which can be viewed from an outside of the container body 310, the positions of the stirring member 500 and the conveying member 600 in the storage container 300 can be recognized from the outside of the container body 310 using the through hole 372. More specifically, when the through hole 372 is located in the highest position as shown in FIG. 3, the stirring member 500 is located in an upper part as shown in FIG. 6, and the conveying member 600 is located in a lower part.

The storage container 300 has the lid member 340, which is used as a sealing part for sealing the filling hole 314, as well as the container body 310, the opening and closing part 350, the operating member 380, and the gear 370. The lid member 340 is mounted to the container body 310 so as to fit into the filling hole 314 after the toner is filled into the container body 310 via the filling hole 314. When the lid member 340 is mounted, the filling hole 314 is sealed, and the toner is prevented from spilling out from the filling hole 314 irrespective of the direction of the container body 310.

The rotary shaft 700 is mounted to the container body 310 so that the rotary shaft 700 can rotate using, for example, a bearing (not shown). Since the gear 370 is mounted to the rotary shaft 700 as mentioned above, the rotary shaft 700 receives a rotational driving force from the gear 370 for rotation. The conveying member 600 is mounted to the rotary shaft 700. Also, the rotary shaft 700 is formed integrally with the stirring member 500. Also, the stirring member 500 and the rotary shaft 700 may be provided as separate members, and the stirring member 500 may be mounted to the rotary shaft 700.

Figure 6:
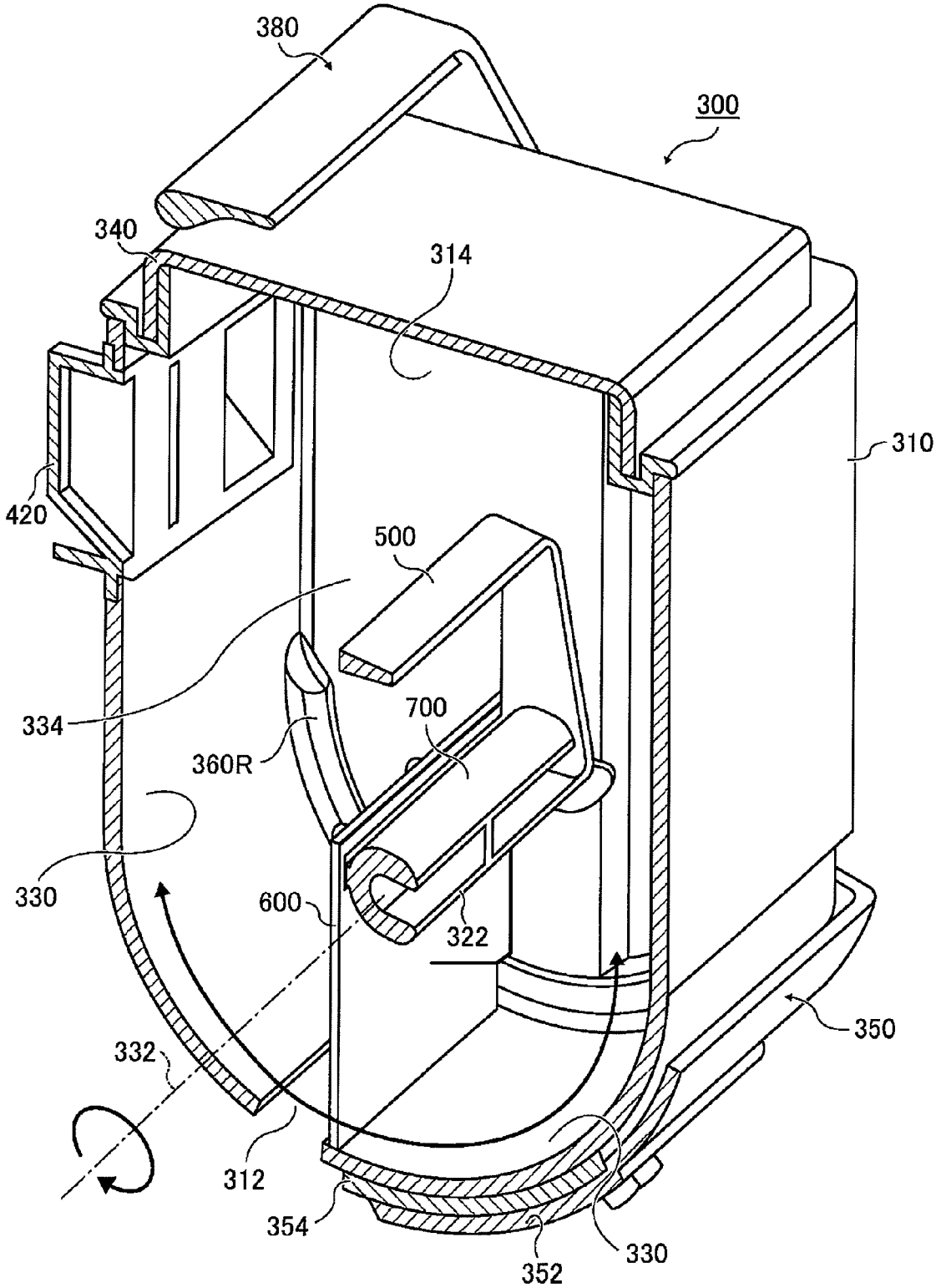
FIG. 6 is a side view showing a section of the storage container according to the exemplary embodiment of the invention.

As shown in FIG. 6, the stirring member 500 and the conveying member 600 are arranged so as to be opposite to each other across the rotary shaft 700. Also, as shown in FIG. 6, the stirring member 500 and the conveying member 600 may be arranged so that the longitudinal direction thereof coincides with a direction along which toner is filled in the storage container 300 (state shown in FIG. 6). More specifically, the stirring member 500 and the conveying member 600 are rotated along with the rotary shaft 700, so that a vertical direction that is a direction in which the container body 310 is filled with the toner, and the longitudinal direction can be made to coincide with each other.

In this way, if the toner is filled in a state where the longitudinal direction of the stirring member 500 and the conveying member 600 coincide with a direction along which the toner is filled, the stirring member 500 and the conveying member 600 hardly serve as an obstacle when the toner is filled into the container body 310. That is, the movement of the toner from the upper side to the lower side can hardly be hindered by the stirring member 500 and the conveying member 600, and the toner is filled into the vertically long container body 310.

Also, if toner is filled into the container body 310 so that a member having a higher strength among the stirring member 500 and the conveying member 600 is arranged on a side (e.g. an upper side) where the toner is filled, a member having a lower strength among the stirring member 500 and the conveying member 600 can be hardly damaged. The stirring member 500 is made of a resin having a predetermined strength, and the conveying member 600 is made of a film-like member having flexibility. In this exemplary embodiment, toner is filled into the container body 310 so as to fall from above in a state where the stirring member 500 whose strength is relatively high is arranged on the upper side, and the conveying member 600 whose strength is relatively low is arranged on the lower side. In the case where the conveying member 600 is made of the film-like member having flexibility, if toner is filled so as to fall from above with the conveying member 600 being arranged on the lower side, such a possibility can be reduced that the film-like member having flexibility is deformed by a pressure of the toner and that the filling of the toner is hindered. Also, it is also possible to avoid the situation where the toner is repelled by the film-like member deformed by the pressure of the toner, and the toner is spilt without entering the container body 310.

As the stirring member 500 rotates in a direction shown by an arrow in FIG. 6 within the container body 310 along with the rotary shaft 700, the stirring member 500 stirs the toner stored in the container body 310. As the toner is stirred by the stirring member 500, for example, the toner anchored to a side inner face of the container body 310 is broken down. Also, the toner which is brought into a state where a large number of particles are solidified is loosened by the stirring member 500.

As the conveying member 600, for example, a material having flexibility, such as a film-like PET (POLYETHYLENE TEREPHTHALATE), is used. An end portion of the conveying member 600 comes into contact with at least a portion of an inner face of the container body 310, and the conveying member 600 rotates so as to be rubbed against at least a portion of the inner face of the container body 310, thereby conveying toner to the discharge hole 312. The conveying member 600 is configured to come into contact with the vicinity of the portion, at least inside the container body 310, in which the discharge hole 312 is formed, and to be rubbed against the vicinity of the portion, at least inside the container body 310, in which the discharge hole 312 is formed. More specifically, the conveying member 600 is configured to contact and be rubbed against the portion in which the discharge hole 312 is formed on the upstream and downstream sides in a direction in which the conveying member 600 rotates. Also, in this exemplary embodiment, the conveying member 600 is configured to contact and be rubbed against a curved portion (a portion shown by an arrow of FIG. 6) formed on the inner face of a lower part of the container body 310. Details of the conveying member 600, such as a shape of the conveying member 600, will be described later.

The container body 310 includes a bottom inner face 330 which is a lateral and bottom inner face, a front inner face 332 which is an inner face located on the front side (see FIG. 9), and a rear inner face 334 which is an inner face located on the rear side. The bottom inner face 330 is used as a first inner face inside the container body 310 and is used as a bottom inner face of the container body 310. The front inner face 332 and the rear inner face 334 are used as second faces of the container body 310 which intersect the bottom inner face 330.

Figure 9:
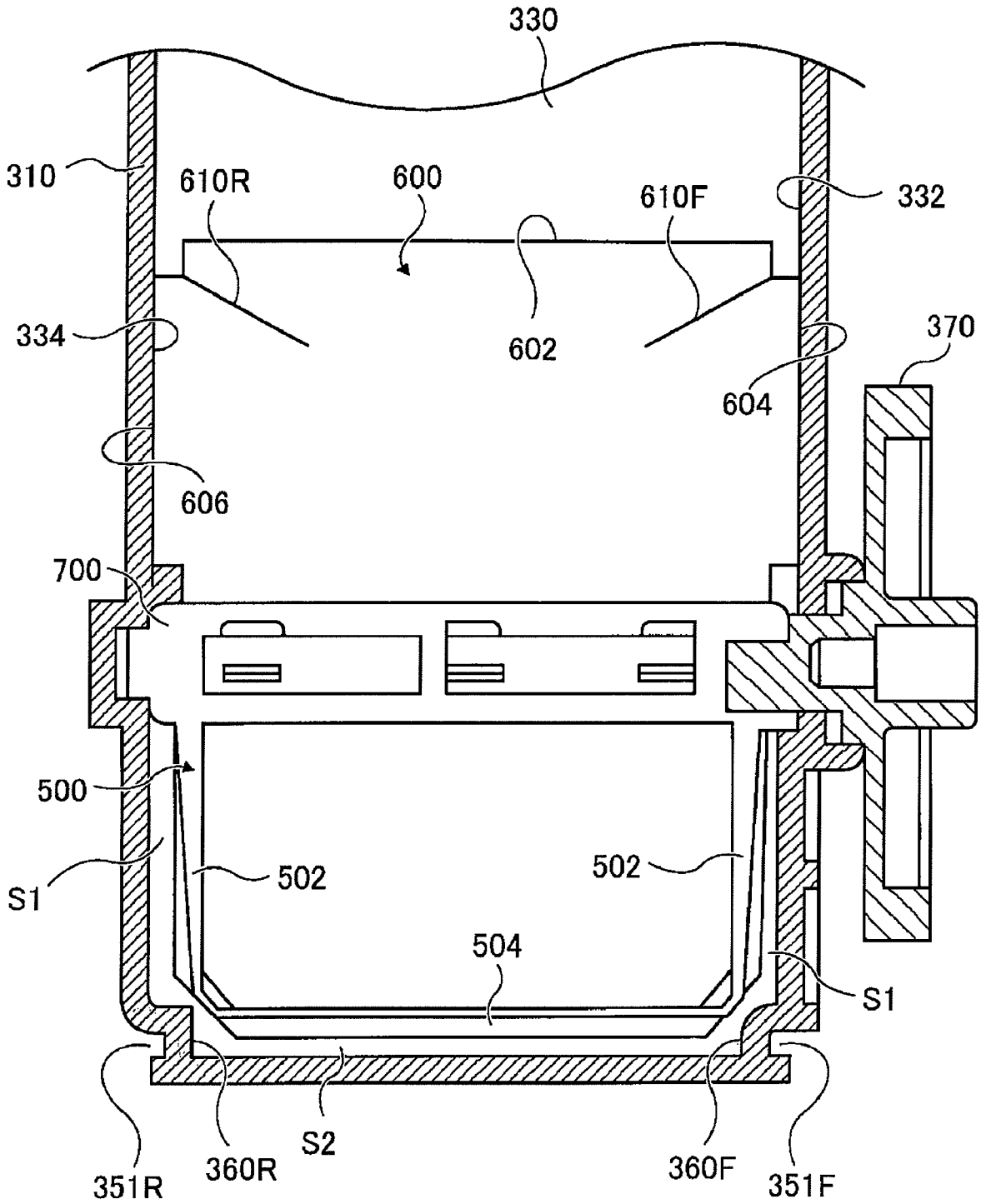
FIG. 9 is a view showing a state where a conveying member and a stirring member which are provided in the storage container according to the exemplary embodiment of the invention are mounted to the container body, when viewed from a left side of the storage container.

Also, a guide groove 351F is provided on the front side and a guide groove 351R is provided on the rear side so that the opening and closing part 350 can be attached to the container body 310 so as to be movable with respect to the container body 310 (also see FIG. 9). Also, since the front groove 351F is provided in the front position, a convex portion 360F is formed on the inner face of the container body 310 so as to protrude toward the inside of the container body 310 (see FIG. 9). Also, since the rear groove 351R is provided in the rear position, a convex portion 360R is formed on the inner face of the container body 310 so as to protrude toward the inside of the container body 310.

FIGS. 7A to 7C and 8A to 8C explain an operation of the operating member 380.

Figure 7A:
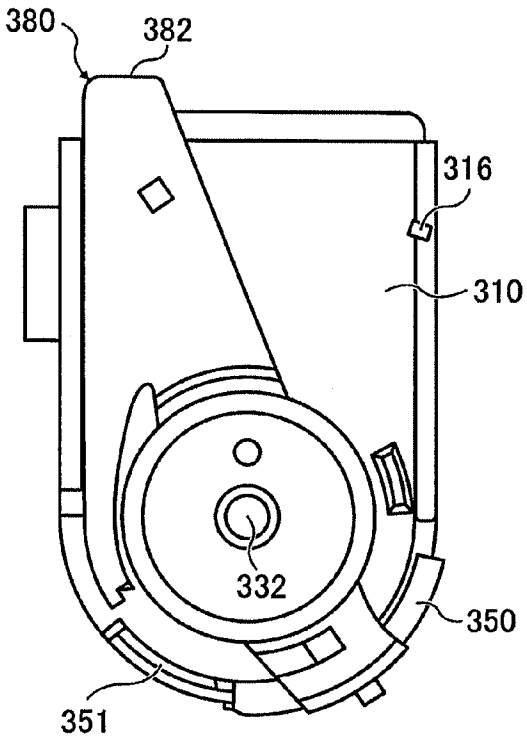
FIGS. 7A to 7C illustrate movement of an operating member of the storage container according to the exemplary embodiment of the invention, and specifically.
Figure 7B:
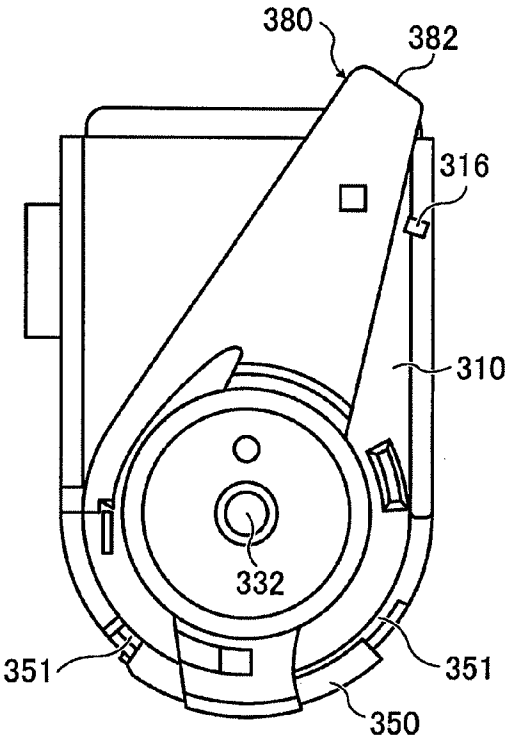
Figure 7C:
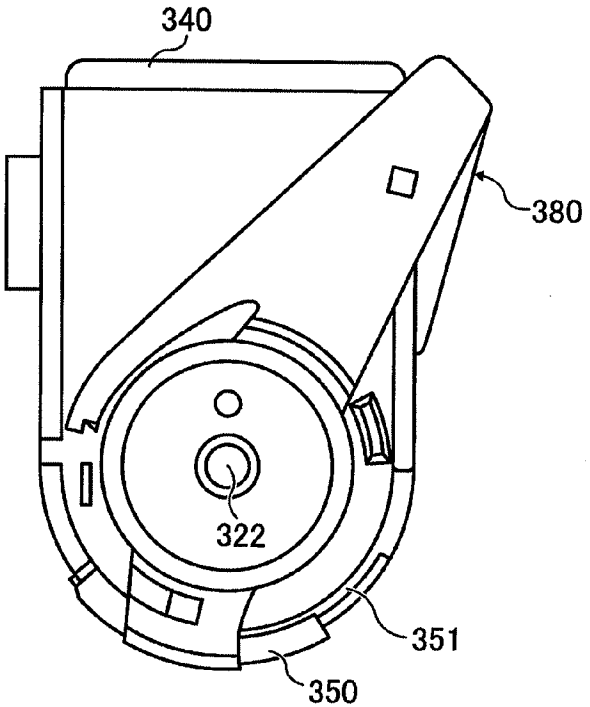
Figure 8C:
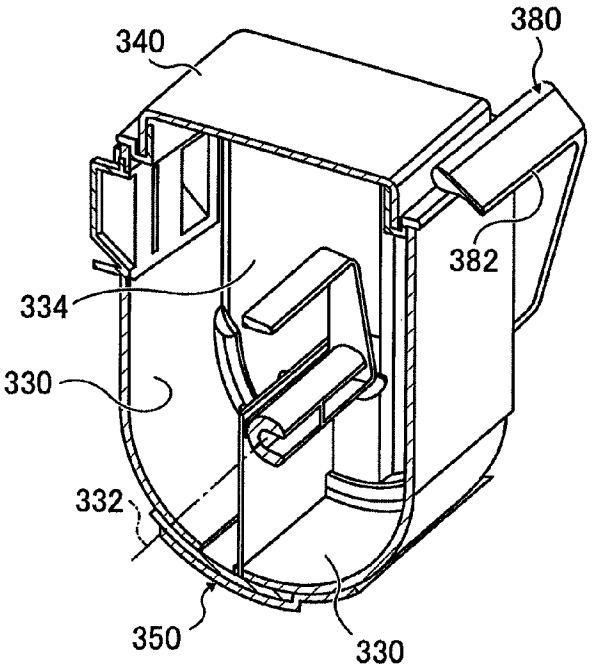
FIGS. 8A to 8C illustrate the movement of the operating member of the storage container according to the exemplary embodiment of the invention, and specifically.
Figure 8B:
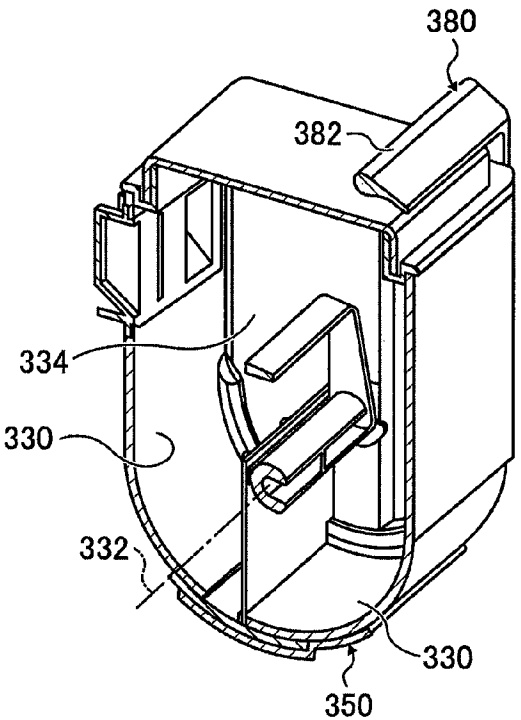
Figure 8A:
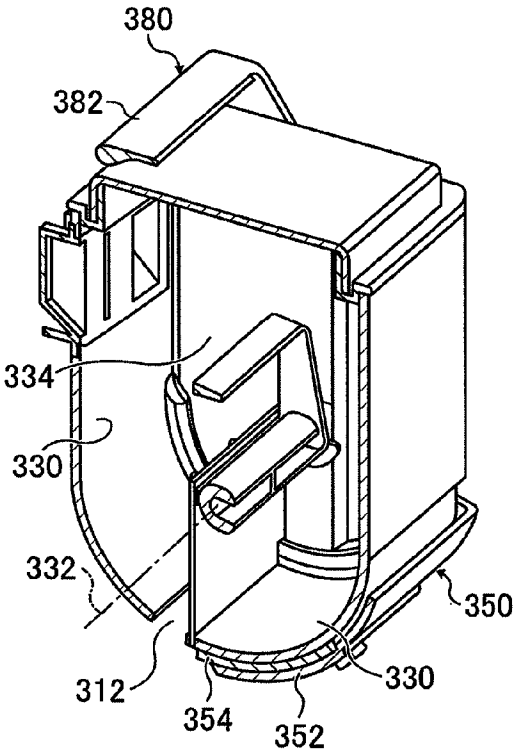

The operating member 380 can be moved between the first position shown in FIGS. 7A and 8A, the second position shown in FIGS. 7B and 8B, and the third position shown in FIGS. 7C and 8C.

The first position shown in FIGS. 7A and 8A is a position where the discharge hole 312 formed in the container body 310 is brought into the opened state. That is, when the operating member 380 is located in the first position, the opening and closing part 350 connected with the operating member 380 is brought into a state of being arranged in a position apart from the discharge hole 312. When the storage container 300 is mounted to the image forming apparatus body 20 so as to supply the toner to the developing device 110, the operating member 380 is operated so as to be brought into the state of being arranged in the first position.

The second position shown in FIGS. 7B and 8B is a state where the discharge hole 312 is closed and the facing portion 382 of the operating member 380 is arranged in a position where the facing portion 382 overlaps the filling hole 314 in the direction (vertical direction in this exemplary embodiment) along which the storage container 300 is filled with toner. When the operating member 380 is located in the second position, the opening and closing part 350 connected with the operating member 380 is brought into a state of being arranged in the position where the opening and closing part covers the discharge hole 312 and the discharge hole 312 is brought into a state of being blocked.

The third position shown in FIGS. 7C and 8C is a state where the discharge hole 312 is closed and the facing portion 382 of the operating member 380 is arranged in a position where the facing portion 382 does not overlap the filling hole 314 in the direction (vertical direction in this exemplary embodiment) along which the storage container 300 is filled with toner. When the operating member 380 is located in the third position, the opening and closing part 350 connected with the operating member 380 is brought into a state of being arranged in the position where the opening and closing part covers the discharge hole 312 and the discharge hole 312 is brought into a state of being blocked. Since the operating member 380 and the opening and closing part 350 are connected together, when the operating member 380 is moved to the third position from the second position, the opening and closing part 350 also moves in conjunction with the movement of the operating member 380. However, since the size of the opening and closing part 350 is formed to be larger than that of the discharge hole 312, the opening and closing part 350 moves with the discharge hold 312 being blocked, i.e., in a state where the sealing member 354 of the opening and closing part 350 seals the discharge hole 312. Also, when the operating member 380 is located in the third position, the facing portion 382 is brought into the state where the facing portion 382 does not overlap the filling hole 314 in the vertical direction that is the direction along which the container body 310 is filled with toner.

The guide grooves 351F, 351R are provided so as to extend in both the opening and closing directions of the opening and closing part 350, i.e., not only in the opening direction of the opening and closing part 350 but also in the closing direction of the opening and closing part 350, when the opening and closing part 350 is located in the second position. When the opening and closing part 350 is moved between the second position and the third position, the opening and closing part 350 is guided by the guide grooves 351F, 351R while being kept in a state where the sealing member 354 of the opening and closing part 350 seals the discharge hole 312.

When it is attempted to mount the storage container 300 to the image forming apparatus body 20 in a state where the operating member 380 is located at the third position, the operating member 380 and the image forming apparatus body 20 interfere with each other. That is, the operating member 380 is used as an interference part which interferes with the image forming apparatus body 20 when the storage container 300 is mounted to the image forming apparatus body 20 in the state where the operating member 380 is located in the third position.

When the operating member 380 is located in the third position and toner is filled into the container body 310, the facing portion 382 hardly hinders movement (falling) of the toner. After the operating member 380 is arranged in the third position and toner is filled into the container body 310, the filling hole 314 of the container body 310 is closed by the lid member 340.

Figure 10:
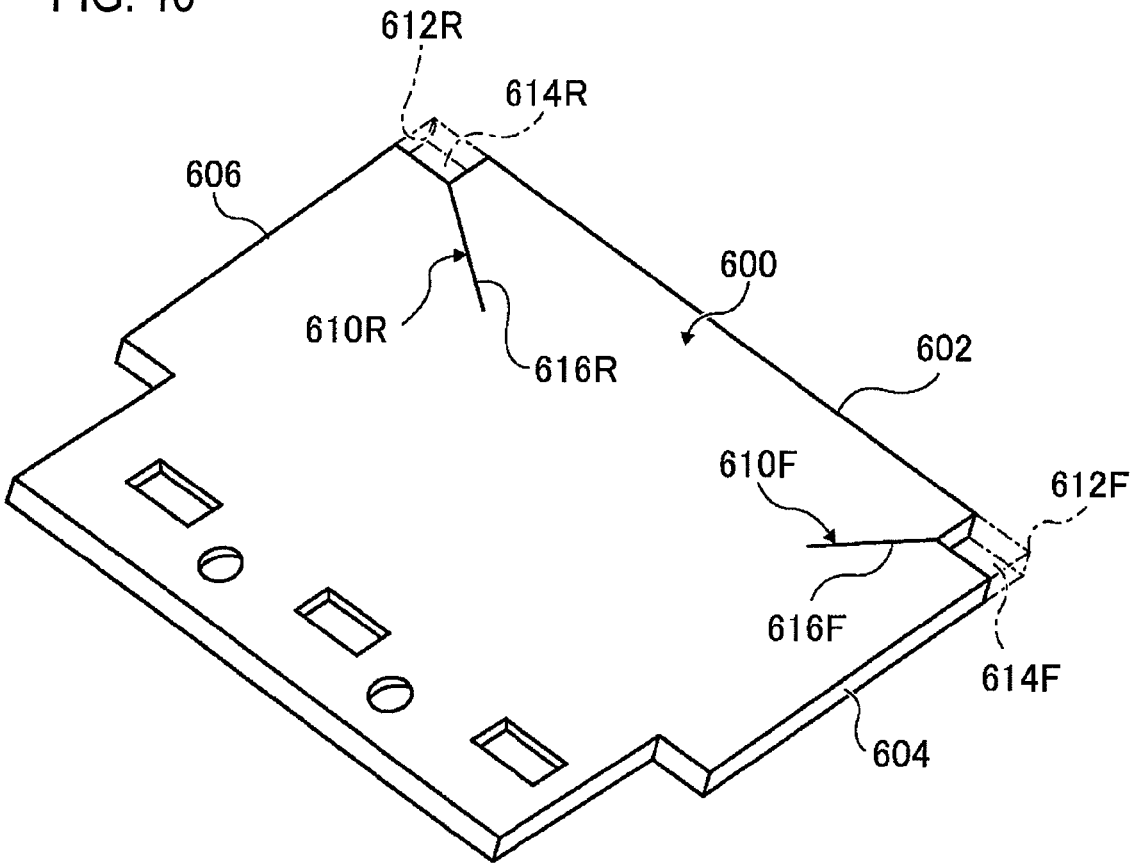
FIG. 10 is a perspective view showing the conveying member provided in the storage container according to the exemplary embodiment of the invention.

FIG. 9 shows the stirring member 500, the conveying member 600, and the rotary shaft 700. FIG. 10 shows the conveying member 600. As shown in FIG. 9, the stirring member 500 has arm portions 502 and 502 connected with the rotary shaft 700, and a connecting part 504 which connects the two arm portions 502 and 502. The connecting part 504 is substantially parallel to the rotary shaft 700. Slight spaces (gap) S1 and S1 are formed between the arm portions 502 and 502 and the inner face of the container body 310. Also, a slight spaces S2 is formed between the connecting part 504 and the inner face of the container body 310. In this manner, the stirring member 500 moves in the vicinity of the inner face of the container body 310.

In this manner, since the stirring member 500 moves in the vicinity of the inner face of the container body 310, for example, the toner located in the vicinity of the inner face of the container body 310, such as the toner anchored to the inner face of the container body 310 can be stirred well.

As shown in FIGS. 9 and 10, the conveying member 600 includes a lateral end portion 602 which is substantially parallel to the rotary shaft 700, a front end portion 604 located on the front side and a rear end portion 606 located on the rear side. The lateral end portion 602 is an end portion configured to come into contact with the bottom inner face 330 of the container body 310. The lateral end portion 602 is used as a first end portion which comes into contact with an upstream side and a downstream side, in the rotation direction of the conveying member 600, of a part where the discharge hole 312 (see FIG. 6) is formed. The front end portion 604 is used as a second end portion which comes into contact with the front inner face 332 of the container body 310. Also, the rear end portion 606 is a second end portion which is comes into contact with the rear inner face 334 of the container body 310. The conveying member 600 includes a slit 610F and a slit 610R.

The slit 610F is formed between the lateral end portion 602 and the front end portion 604. Also, a corner 612F of the conveying member 600 which is located between the lateral end portion 602 and the front end portion 604 is removed. In the corner 612F, a tip end of the lateral end portion 602 and a tip end of the front end portion 604 coincide with each other. The slit 610F extends from the portion from which the corner 612F is removed toward the inside of the conveying member 600. More specifically, the slit 610F is provided by forming a rectangular slit in a position between the lateral end portion 602 and the front end portion 604 of the conveying member 600 (a position of the corner 612F) and obliquely forming, for example, a linear slit from the portion of the rectangular slit. That is, the slit 610F includes a rectangular removed portion 614F which is removed and a linear portion 616F which is, for example, the linear slit.

The slit 610R is formed between the lateral end portion 602 and the rear end portion 606. Also, A corner 612R of the conveying member 600 which is located between the lateral end portion 602 and the front end portion 604 is removed. In the corner 612R, a tip end of the lateral end portion 602 and a tip end of the rear end portion 606 coincide with each other. The slit 610R extends from the portion from which the corner 612R is removed toward the inside of the conveying member 600. More specifically, the slit 610R is provided by forming a rectangular slit in a position between the lateral end portion 602 and the rear end portion 606 of the conveying member 600 (a position of the corner 612R) and obliquely forming, for example, a linear slit from the portion of the rectangular slit. That is, the slit 610R includes a rectangular removed portion 614R which is removed and a linear portion 616R which is, for example, the linear slit.

Since the slit 610F is formed, the portions of the conveying member 600 in which the slit 610F is formed are easily deformed so as to overlap with each other. Therefore, as the conveying member 600 is deformed, the conveying member 600 can be brought into contact with both the bottom inner face 330 and the front inner face 332 which have a positional relationship of intersecting each other. Similarly, since the slit 610F is formed, the conveying member 600 can be brought into contact with both the bottom inner face 330 and the rear inner face 334 in the positions which intersect each other. Accordingly, as the stirring member 500 moves in the vicinity of the inner face of the container body 310, the toner located in the vicinity of the inner face of the container body 310 can be stirred well, and following this, the conveying member 600 comes into contact with and is rubbed against the inner face of the container body 310. Thus, for example, the toner located in the vicinity of the inner face of the container body 310, such as the toner anchored to the inner face of the container body 310, can be conveyed well.

Figure 11B:
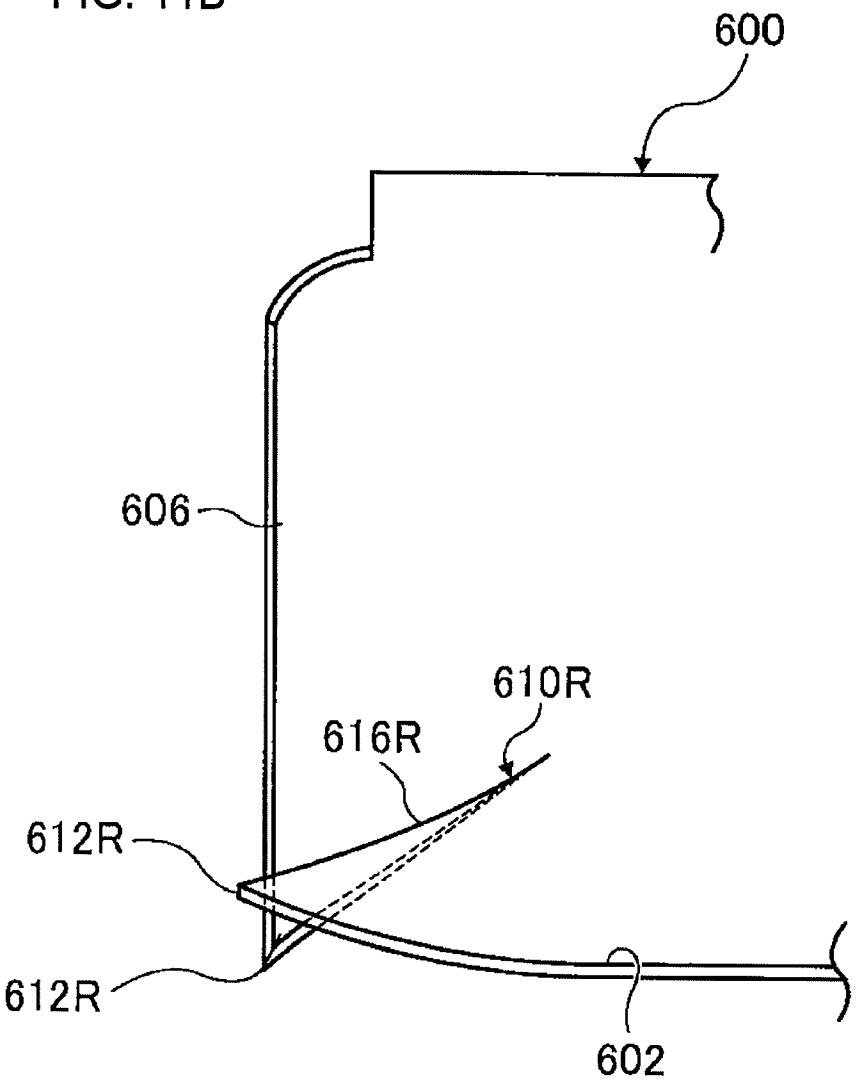
FIGS. 11A and 11B are view for explaining an operation of the conveying member.
Figure 11A:
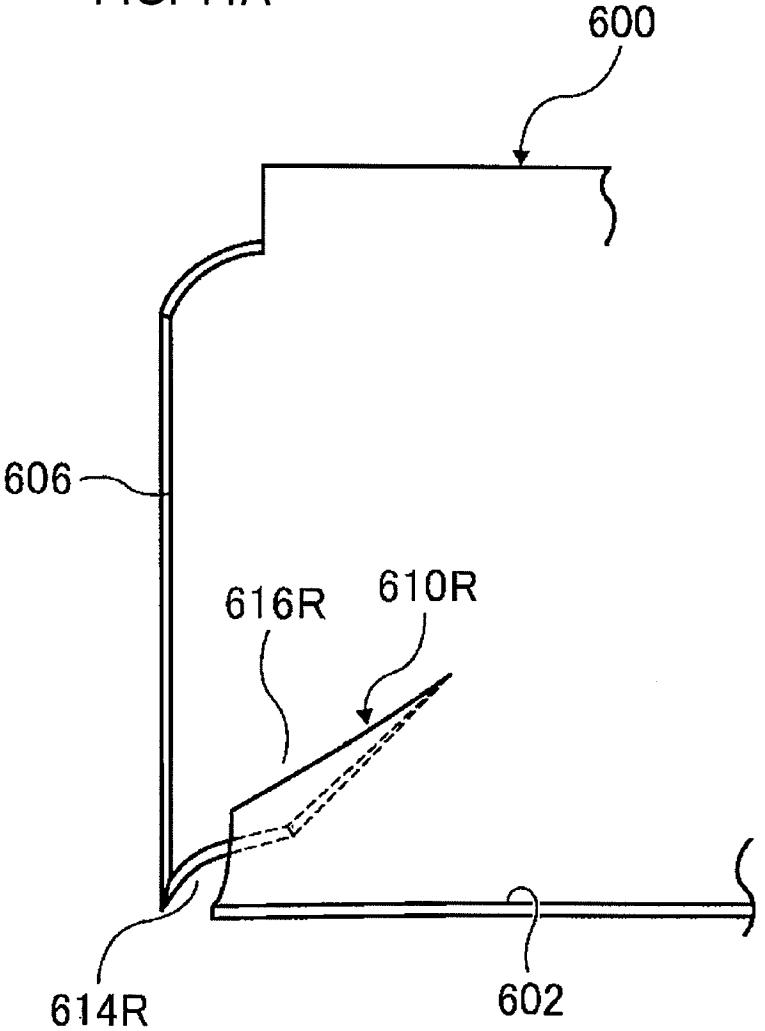

FIGS. 11A and 11B are view for explaining an operation of the conveying member. FIG. 11A is an enlarged view showing a part of the conveying member provided in the storage container according to the exemplary embodiment of the invention, and FIG. 11B is an enlarged view showing a part of a conveying member of Comparative Example In the conveying member 600 according to the exemplary embodiment of the invention, the slit 610R includes the removed portion 614R in the position of the corner 612R and the linear portion 616R. To the contrary, in the conveying member 600 according to Comparative Example shown in FIG. 11B, the slit 610R has no removed portion 614R, but only has the linear 616R which is formed from the corner 612R. Also, both of FIGS. 11A and 11B show the conveying member 600 in which (a) the lateral end portion 602 of the conveying member 600 is deflected with being in contact with the bottom inner face 330, which is the inner face of the container body 310 and (b) the rear end portion 606 of the conveying member 600 is deflected with being in contact with the rear inner face 334, which is the rear inner face of the container body 310.

As shown in FIG. 11B, the conveying member 600 according to Comparative Example has no removed portion 614R in the position of the corner 612R. Therefore, there is a concern that a part of the rear end portion 606 on the lateral end portion 602 side might enter below a part of the lateral end portion 602 on the rear end portion 606 side. Then, in this case, the rear end portion 606 would lift up the part of the lateral end portion 602 on the rear end portion 606 side, and the lateral end portion 602 would be separate from the inner face of the container body 310. Then, if the lateral end portion 602 and the inner face of the container body 310 are separate from each other, a gap would be formed between the lateral end portion 602 and the inner face of the container body 310, a toner would pass through the gap, and the toner would not be stirred and conveyed well. As a result, there is a concern that some toner might stay in a certain position.

FIG. 11B shows the case where the lateral end portion 602 is lifted up. However, there is an opposite case where the lateral end portion 602 enters below the rear end portion 606. In this case, the lateral end portion 602 lifts up the rear end portion 606, and the rear end portion 606 is separate from the inner face of the container body 310. In this case, a gap would be formed between the rear end portion 606 and the inner face of the container body 310, a toner would pass through the gap, and the toner would not be stirred and conveyed well. As a result, there is a concern that some toner might stay in a certain position.

To the contrary, in the conveying member 600 according to the exemplar embodiment of the invention, the slit 610R has the removed portion 614R. Therefore, it hardly occurs that one of the lateral end portion 602 and the rear end portion 606 lifts up the other, and then the conveying member 600 is separate from the inner face of the container body 310. As shown in FIG. 11A, such a state tends to be maintained that the lateral end portion 602 is in contact with the bottom inner face 330 which is the inner face of the container body 310 and that the rear end portion 606 is in contact with the rear end face 334 of the container body 310. Also, the toner hardly passes, and the toner would be well stirred and conveyed.

As described above, by forming in the position of the corner 612R the removed portion 614R which is, for example, the rectangular slit, a gap is hardly formed between the conveying member 600 and the inner face of the container body 310, and the toner is well stirred and conveyed. Similarly thereto, by forming in the position of the corner 612F the removed portion 614F which is the rectangular slit, a gap is hardly formed between the conveying member 600 and the inner face of the container body 310 as compared with the case where the removed portion 614F is not formed in the position of the corner 612F, and the toner is well stirred and conveyed.

Shapes and sizes of the removed portions 614F and 614R may be set appropriately so long as an end portion of the conveying member 606 is not lifted up and the toner does not pass through the gap formed between the conveying member 600 and the container body 310. Also, shapes and lengths of the linear portions 616F and 616R may be set appropriately so long as an end portion of the conveying member 606 is not lifted up and the toner does not pass through the gap formed between the conveying member 600 and the container body 310. For example, the removed portions 614F and 614R may have a polygonal shape such as a triangular shape or a pentagon shape, or a curved-face shape such as an arc shape or an elliptic arc shape. Also, the linear portions 616F and 616R may be curved.

Also, FIGS. 9 and 10 show that the slit 610F is identical in shape, size, length and direction with the slit 610Ra and that the position of the corner 612F with respect to the front end portion 604 is the same as the position of the corner 612R with respect to the rear end portion 606. However, the slits 610F and 610R may be different in size, length, direction and shape from each other, for example, depending on the inner shape of the container body 310.

Also, in the exemplary embodiment, as shown in FIG. 9, the convex portion 360F has an arc shape, and the convex portion 360R has a substantially linear shape. The convex portion 360F is different in shape from the convex portion 360R. According to the experimental result, even in this case, no trouble occurs in which any of the lateral end portion 602, the front end portion 604 and the rear end portion 606 of the conveying member 600 is lifted up, a gap is formed between the conveying member 600 and the container body 310, and the toner passes through the gap. Therefore, although the convex portions 360F and 360R are different in shape from each other, the remove portions 614F and 614R have the same shape without conforming with the shapes of the convex portions 360F and 360R, respectively.

In the exemplary embodiment, the removed portion 614F is substantially identical in shape and size with the convex portion 360F. Also, the removed portion 614R is substantially identical in shape and size with the convex portion 360R. Even if the convex portions 360F and 360R were not to be formed, it would be preferable to form the removed portion 614F in the position of the corner 612F and form the removed portion 614R in the position of the corner 612R. Thereby, as described above, such a trouble can be prevented in which a gap is formed between the conveying member 600 and the container body 310 and a gap passes through the gap.

Figure 12:
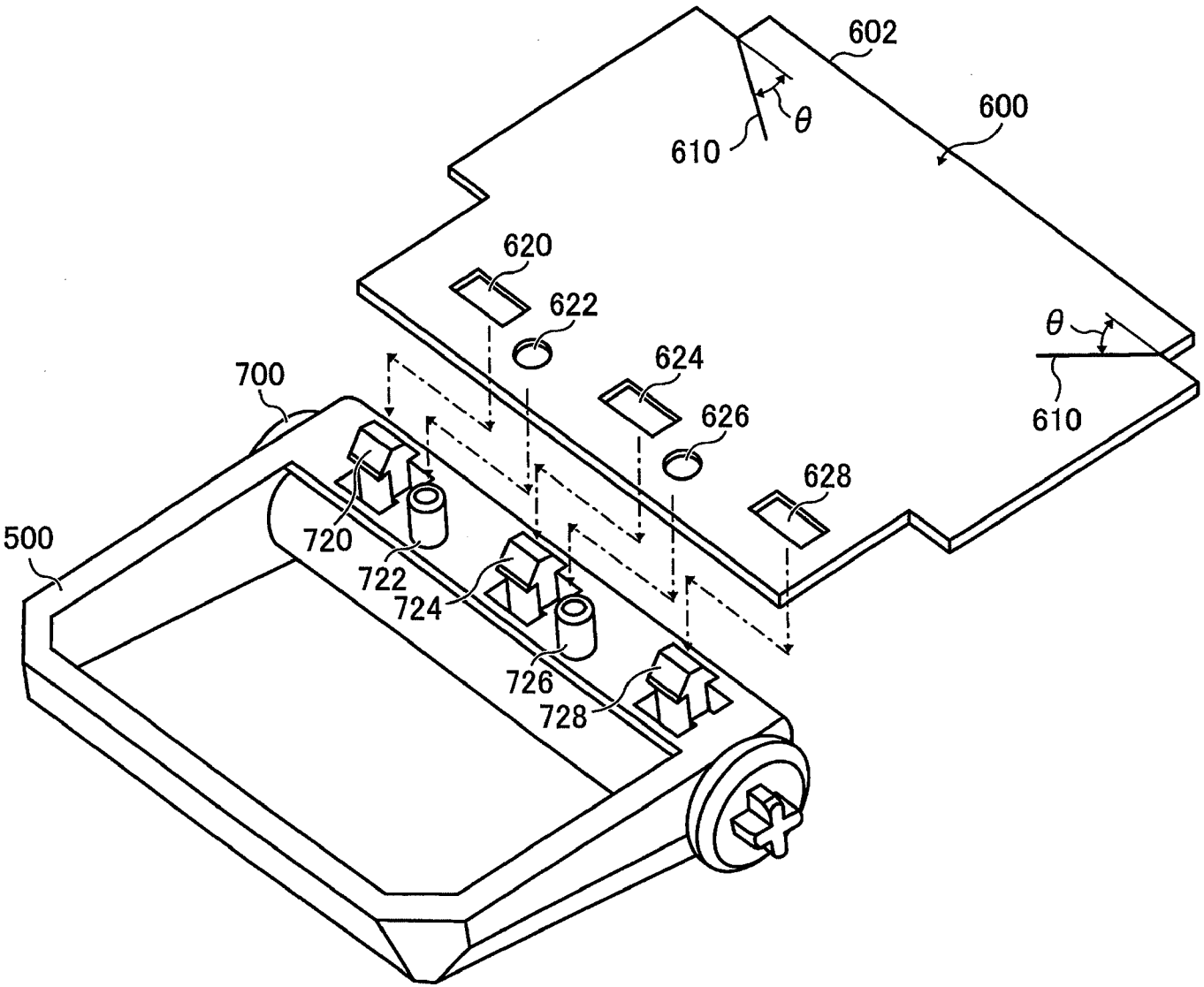
FIG. 12 is a perspective view showing the conveying member, the stirring member, and a rotary shaft of the storage container according to the exemplary embodiment of the invention.

FIG. 12 is an exploded view showing the rotary shaft 700 and the conveying member 600. As shown in FIG. 12, the conveying member 600 is formed with through holes 620, 622, 624, 626, and 628. Also, the rotary shaft 700 is formed with projections 720, 722, 724, 726, and 728 having shapes corresponding to the through holes 620, 622, 624, 626, and 628. The conveying member 600 is mounted to the rotary shaft 700 so that the projections 720, 722, 724, 726, and 728 are inserted into the through holes 620, 622, 624, 626, and 628, respectively.

Angles θ formed between the slits 610F and 610R and the lateral end portion 602 of the conveying member 600 are equal to each other, and θ is, for example, about 30 degrees.

Figure 13B:
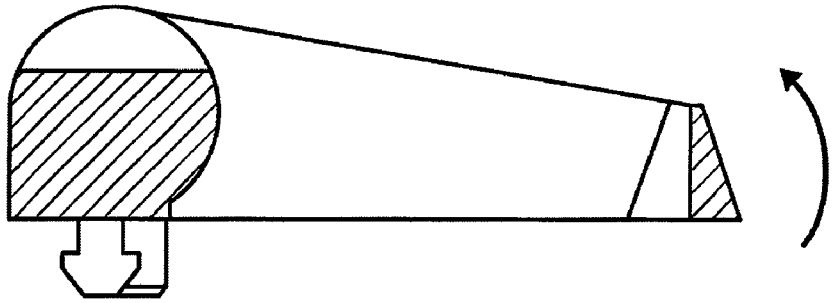
FIGS. 13A and 13B show the stirring member and the rotary shaft of the storage container according to the exemplary embodiment of the invention.
Figure 13A:
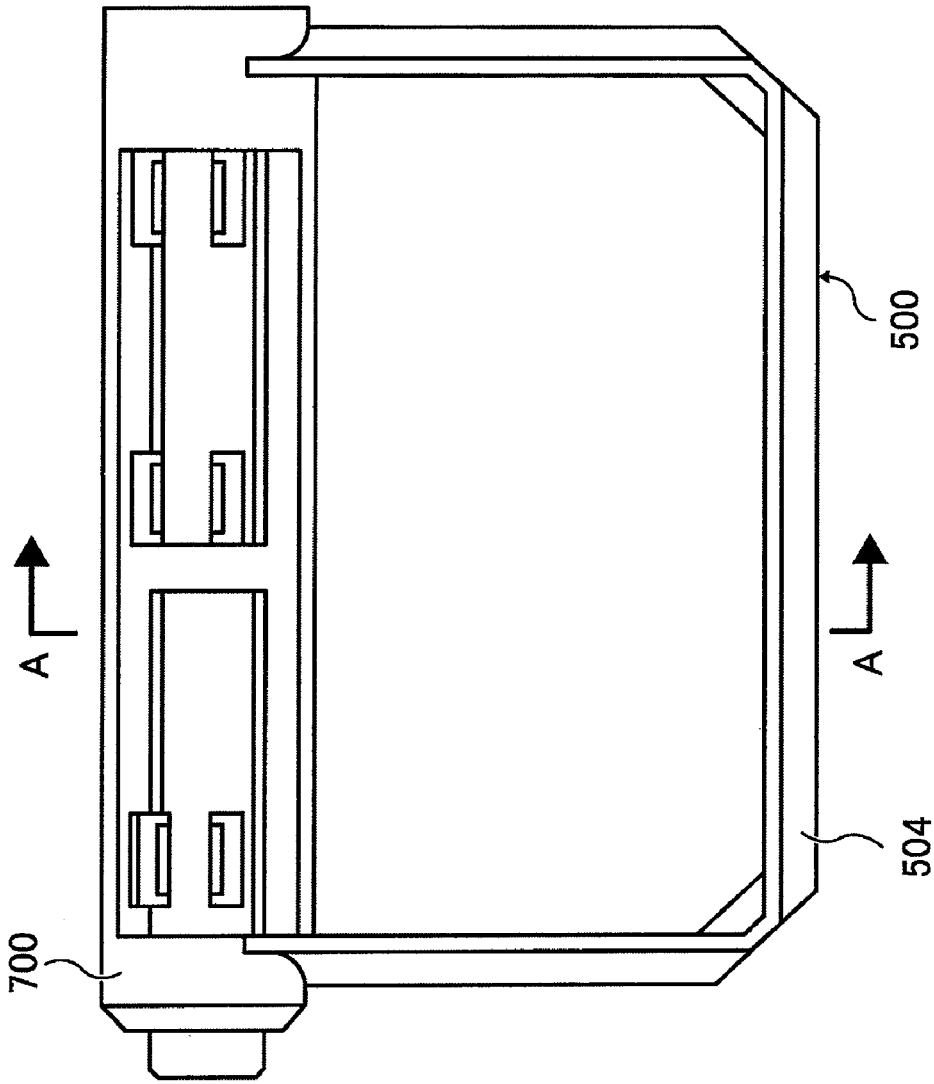

FIGS. 13A and 13B show the stirring member 500 and the rotary shaft 700. As shown in FIG. 13B, a section of the connecting part 504 of the stirring member 500 is formed in a wedge shape whose section area on the front side in a moving direction gets smaller. Therefore, the movement of the stirring member 500 in the toner becomes smooth. An arrow in FIG. 13B shows a direction in which the conveying member 600 moves in the container body 310.

Figure 14:
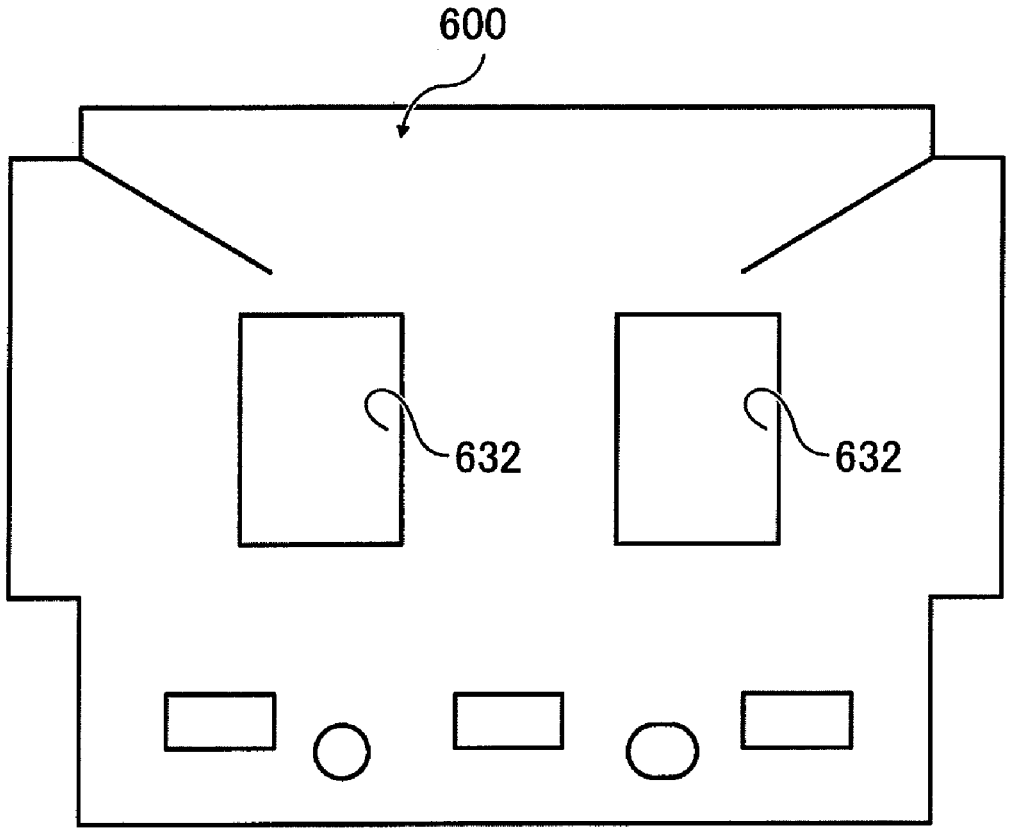
FIG. 14 is a view showing a modified example of the conveying member of the storage container according to the exemplary embodiment of the invention.

FIG. 14 shows a modified example of the conveying member 600. The conveying member 600 according to this modification example is formed with passing holes 632 and 632. When the conveying member 600 moves in toner, the toner passes through the passing holes 632 and 632.

Figure 15:
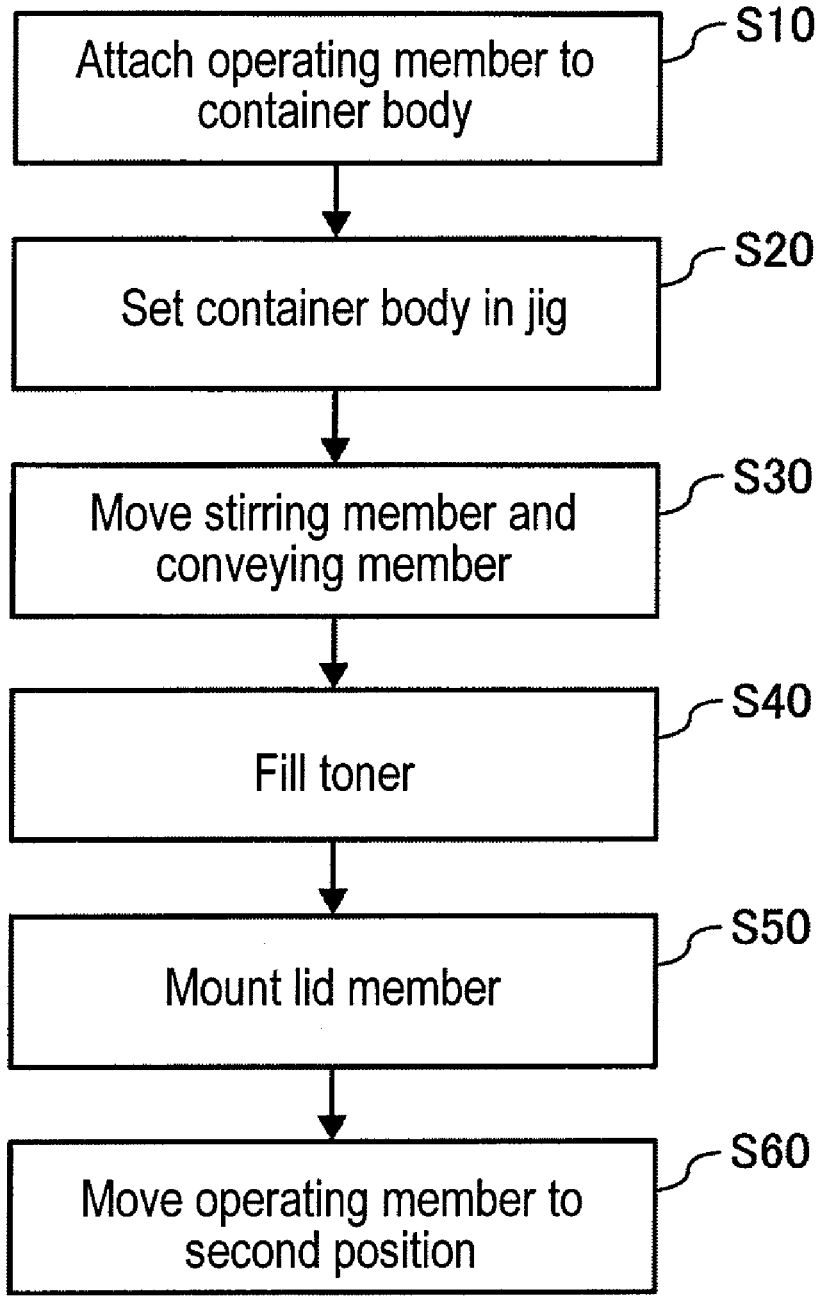
FIG. 15 is a view showing a process of filling toner into the storage container according to the exemplary embodiment of the invention.

For example, FIG. 15 shows steps of filling toner into the storage container 300 during a manufacturing process. As shown in FIG. 15, in order to fill the storage container 300 with toner, at a first step S10, the operating member 380 is attached to the container body 310. At this time, a protruding portion 326 which protrudes from a supporting projection 324 of the container body 310 is required to fit to a large-diameter portion 410 formed in a through hole 408 of the operating member 380, and the operating member 380 is assembled to the container body 310 so as to be located in the third position.

At this time, the operating member 380 is fixed to the third position so that the fixing projection 316 enters the through hole 390. Therefore, the operating member 380 is prevented from moving when toner is filled into the container body 310 at step S30 which will be described later, and poor filling of the toner due to moving of the operating member 380 hardly occurs.

At the next step S20, the container body 310 is set in a jig (not shown) so that the filling hole 314 is turned upward.

At the next step S30, for example, by rotating the gear 370 while confirming the position of the through hole 372 formed in the gear 370 from the outside of the container body 310, the stirring member 500 and the conveying member 600 are moved so that the longitudinal direction of the stirring member 500 and the conveying member 600 coincide with the vertical direction, which is the direction along which the container body 310 is filled with toner.

At the next step S40, the toner is filled into the container body 310 so as to fall from above via the filling hole 314. At this time, since the operating member 380 is located at the third position and the facing portion 382 of the operating member 380 is located at a position where the facing portion does not overlap the filling hole 314 in the direction (vertical direction) along which toner is filled, the operating member 380 does not hinder the filling of the toner.

Also, since the stirring member 500 and the conveying member 600 are moved so that the longitudinal direction of the stirring member 500 and the conveying member 600 coincide with the vertical direction, the falling of the toner into the container body 310 is hardly hindered, the toner easily reaches the bottom of the container body 310, and the toner is filled without the space within the container body 310 being made useless.

At the next step S50, the lid member 340 is mounted to the filling hole 314 to seal the filling hole 314. At this time, since the operating member 380 is located in the third position and the facing portion 382 of the operating member 380 is located in the position at which the facing portion 382 does not overlap the filling hole 314 in the direction (vertical direction) along which the toner is filled, the operating member 380 does not hinder the lid member 340 from being mounted to the container body 310.

At the next step S60, the operating member 380 is moved to the second position from the third position. In order to move the operating member 380 to the second position, for example, the fixing projection 316 is detached from the through hole 390 by deforming the front arm portion 384 of the operating member 380. By moving the operating member 380 to the second position, the facing portion 382 of the operating member 380 moves to a position where the facing portion 382 overlaps the filling hole 314 in the direction along which the toner is filled. Therefore, in a direction which intersects the direction along which toner is filled, a width of the storage container 300 becomes small, and the conveyance of the storage container 300 becomes easy. Also, even if an attempt to move the operating member 380 which has been moved to the second position again to the third position is made, the front arm portion 384 of the operating member 380 and the fixing projection 316 abut against each other and interfere with each other, the operating member 380 is prevented from moving to the third position when there is no need.

When the operating member 380 is moved to the second position from the third position, the operating member 380 may move to the first position from the second position erroneously, and the discharge hole 312 may be brought into the open state. As a result, there is a possibility that toner may be discharged from the discharge hole 312. However, unless the storage container 300 is mounted into the image forming apparatus body 20, the operating member 380 is prevented from moving to the first position from the second position by the prohibiting projection 318.

Also, in the exemplary embodiments described above, the case has been described where a printer is used as an example of an image forming apparatus. However, the image forming apparatus of the invention includes other single-function apparatuses which performs a process using an image forming agent, such as a copying machine and a facsimile, or other apparatuses which have plural functions, such as a printer and a scanner, and which perform a process using an image forming agent. The invention is also applicable to these image forming apparatuses. Also, the image forming apparatus of the invention also includes apparatuses, such as visual equipment, such as a television, a DVD player, and an HDD, into which components which form an image using an image forming agent are incorporated, and the invention can be applied to these image forming apparatuses. Also, the image forming apparatus of the invention also includes apparatuses which are incorporated into, for example, a desk, a shelf, a wall, etc., and which form an image using an image forming agent, and the invention can be applied to these image forming apparatuses.

As described above, the invention is applicable to an image forming agent storage container, an image forming apparatus, a method of mounting the image forming agent storage container, and a method of removing the image forming agent storage container.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

DESCRIPTION OF REFERENCE NUMERALS AND SIGNS

10: IMAGE FORMING APPARATUS
100: IMAGE FORMING PART
300: STORAGE CONTAINER
310: CONTAINER BODY
312: DISCHARGE HOLE
314: FILLING HOLE
330: BOTTOM INNER SURFACE
332: FRONT INNER SURFACE
334: REAR INNER SURFACE
351F, 351R: GUIDE GROOVES
360F, 360R: CONVEX PORTIONS

370: GEAR
372: THROUGH HOLE
500: STIRRING MEMBER
502: ARM PORTION
504: CONNECTING PART
600: CONVEYING MEMBER
610F, 610R: SLITS
612F, 612R: CORNERS
614F, 614R: REMOVED PORTIONS
616F, 616R: LINEAR PORTIONS
632: PASSING HOLE
700: ROTARY SHAFT

What is claimed is:

1. An image forming agent storage container comprising:

a container body formed with a discharge hole that is used to discharge an image forming agent;

a rotary shaft that rotates in the container body;

a stirring part that rotates together with the rotary shaft and stirs an image forming agent stored in the container body; and a conveying member that has flexibility, rotates together with the rotary shaft, and conveys the image forming agent in the container body, wherein the conveying member includes a first end portion that comes into contact with a lower inner face of the container body and comes into contact with the lower inner face of the container body on an upstream side and a downstream side, in a rotation direction of the conveying member, of a part where the discharge hole is formed, a second end portion that comes into contact with an inner face of the container body which intersects the lower inner face, and a slit formed between the first end portion and the second end portion, a corner of the conveying member which is located between the first end portion and the second end portion is removed, and the slit extends from a portion from which the corner is removed toward an inside of the conveying member.

2. The image forming agent storage container according to claim 1, wherein the stirring part and the conveying member are mounted to the rotary shaft so as to be opposite to each other across the rotary shaft.

3. The image forming agent storage container according to claim 1, wherein the conveying member is formed with a passing hole through which the image forming agent passes during movement of the conveying member.

4. The image forming agent storage container according to claim 1, wherein an upper end of the container body is formed with a filling hole used in filling of the image forming agent.

5. The image forming agent storage container according to claim 1, wherein the discharge hole is formed on a lower end side of the container body.

6. The image forming agent storage container according to claim 1, wherein the image forming agent storage container is detachably attached into an image forming apparatus body.

7. The image forming agent storage container according to claim 1, wherein the flexible conveying member extends directly from the rotary shaft.

8. The image forming agent storage container according to claim 1, wherein the stirring member does not contact the inner face of the container body.

9. An image forming apparatus comprising:

an image forming apparatus body;

an image forming agent storage container that is detachably attached to the image forming apparatus body; and an image forming part that forms an image with an image forming agent stored in the image forming agent storage container, wherein the image forming agent storage container includes a container body formed with a discharge hole that is used to discharge an image forming agent, a rotary shaft that rotates in the container body, a stirring part that rotates together with the rotary shaft and stirs an image forming agent stored in the container body, and a conveying member that has flexibility, rotates together with the rotary shaft, and conveys the image forming agent in the container body, the conveying member includes a first end portion that comes into contact with a lower inner face of the container body and comes into contact with the lower inner face of the container body on an upstream side and a downstream side, in a rotation direction of the conveying member, of a part where the discharge hole is formed, a second end portion that comes into contact with an inner face of the container body which intersect the lower inner face, and a slit formed between the first end portion and the second end portion, and a corner of the conveying member which is located between the first end portion and the second end portion is removed, and the slit extends from a portion from which the corner is removed toward an inside of the conveying member.

10. The image apparatus according to claim 9, wherein the flexible conveying member extends directly from the rotary shaft.

11. The image apparatus according to claim 9, wherein the stirring member does not contact the inner face of the container body.

12. A method of filling an image forming agent, the method comprising:

moving a stirring part and a conveying member in an image forming agent storage container so that a longitudinal direction thereof coincides with a direction along which the image forming agent is filled into a container body; and filling the image forming agent into the container body, wherein the image forming agent storage container includes a container body formed with a discharge hole that is used to discharge an image forming agent, a rotary shaft that rotates in the container body, a stirring part that rotates together with the rotary shaft and stirs an image forming agent stored in the container body, and a conveying member that has flexibility, rotates together with the rotary shaft, and conveys the image forming agent in the container body, the conveying member includes a first end portion that comes into contact with a lower inner face of the container body and comes into contact with the lower inner face of the container body on an upstream side and a downstream side, in a rotation direction of the conveying member, of a part where the discharge hole is formed, a second end portion that comes into contact with an inner face of the container body which intersect the lower inner face, and a slit formed between the first end portion and the second end portion, and a corner of the conveying member which is located between the first end portion and the second end portion is removed, and the slit extends from a portion from which the corner is removed toward an inside of the conveying member.

13. The method of filling a forming agent according to claim 12, wherein the flexible conveying member extends directly from the rotary shaft.

14. The method of filling a forming agent according to claim 12, wherein the stirring member does not contact the inner face of the container body.

* * * * *